US009147370B2

(12) United States Patent
Tobita et al.

(10) Patent No.: US 9,147,370 B2
(45) Date of Patent: Sep. 29, 2015

(54) IMAGE DISPLAY APPARATUS

(75) Inventors: Youichi Tobita, Toykyo (JP); Yoshifumi Doi, Tokyo (JP); Hiroyuki Murai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1225 days.

(21) Appl. No.: 12/963,069

(22) Filed: Dec. 8, 2010

(65) Prior Publication Data

US 2011/0148954 A1 Jun. 23, 2011

(30) Foreign Application Priority Data

Dec. 21, 2009 (JP) ..... 2009-289194

(51) Int. Cl.
*G09G 3/36* (2006.01)

(52) U.S. Cl.
CPC ..... *G09G 3/3688* (2013.01); *G09G 2310/0281* (2013.01); *G09G 2310/08* (2013.01)

(58) Field of Classification Search
CPC ..... G09G 3/3688; G09G 2310/0281; G09G 2310/08
USPC ..... 345/87–104, 204
See application file for complete search history.

(56) References Cited

U.S. PATENT DOCUMENTS

| | | | | |
|---|---|---|---|---|
| 4,830,466 | A * | 5/1989 | Matsuhashi et al. | 349/143 |
| 2004/0246246 | A1 | 12/2004 | Tobita | |
| 2008/0192032 | A1 | 8/2008 | Park et al. | |

FOREIGN PATENT DOCUMENTS

| | | |
|---|---|---|
| JP | 60-140323 | 7/1985 |
| JP | 64-25194 | 1/1989 |
| JP | 11-265172 | 9/1999 |
| JP | 2001-228827 | 8/2001 |
| JP | 2002-351426 | 12/2002 |
| JP | 2005-3714 | 1/2005 |
| JP | 2005-173418 | 6/2005 |
| JP | 2006-267942 | 10/2006 |
| JP | 2007-256934 | 10/2007 |
| JP | 2008-176269 | 7/2008 |

OTHER PUBLICATIONS

Japanese Office Action issued Sep. 2, 2014, in Japan Patent Application No. JP2013-228929.
Office Action issued May 28, 2013 in Japanese Patent Application No. 2009-289194 with partial English language translation.

* cited by examiner

*Primary Examiner* — Amr Awad
*Assistant Examiner* — Aaron Midkiff
(74) *Attorney, Agent, or Firm* — Oblon, McClelland, Maier & Neustadt, L.L.P.

(57) ABSTRACT

For an image display apparatus, cost reduction is enabled to prevent display errors while ensuring operational margin to prevent display errors even when the delay time of gate line driving signals is large. A source driver of a liquid-crystal display apparatus includes a data latch circuit for supplying display data to a decode circuit. A gate line inactivation transition detecting circuit detects inactivation of each of a plurality of gate lines and activates a detect signal for a certain period with that timing. The data latch circuit updates the held display data in response to activation of the detect signal.

11 Claims, 20 Drawing Sheets

IMAGE DISPLAY APPARATUS

BACKGROUND OF THE INVENTION

1. Field of the Invention

The present invention relates to image display apparatuses, and particularly to a technique for enlarging the operational margin of writing of an image display signal.

2. Description of the Background Art

Flat panel displays are widely used in order to display images with reduced space and reduced power consumption. In flat panel displays, pixels are arranged in a matrix on an image display panel. Each pixel includes a display element such as a liquid-crystal element and a select transistor for transmitting an image display signal (hereinafter referred to as "display signal") to the display element.

Gate lines (scanning lines) are arranged in correspondence with the rows of pixels, and data lines for transmitting the display signal are arranged in correspondence with the columns of pixels. To each gate line, the gates of the select transistors of the pixels of the corresponding row are connected. To each data line, one current electrodes of the select transistors of the pixels of the corresponding column are connected.

The select period of a gate line is determined by the horizontal scanning period of the display signal. For example, in the NTSC system in which the number of horizontal scanning lines is 525, one horizontal scanning period is 64 μS. As this period is so short, the active matrix system is usually utilized in which one gate line at a time is brought into a selected state (active state) according to the horizontal scanning period, and all select transistors of that line are made conductive and the display signal is written into the pixels. In this system, the gate lines are kept in a non-selected state (inactive state) during the vertical scanning periods other than their own selected periods, and the corresponding select transistors are kept in a non-conducting state in those periods. Accordingly, the pixels maintain the display signal and drive the display elements for one field period and display the corresponding display signal.

For such image display apparatuses, various schemes are devised to enable stable and correct display of images (for example, Japanese Patent Application Laid-Open Nos. 2005-3714, 2008-176269, and 11-265172 (1999), which are hereinafter referred to as Patent Documents 1 to 3, respectively).

In the display apparatus of Patent Document 1, a gate line inactivation detecting circuit (2) is provided at the ends of the gate lines on the side opposite to the connection with the gate line driving circuit (FIG. 19), and a latch instruction signal (LAT) provided as its output is used to operate a second latch circuit (114) for defining the timing of transmission of the display signal to a multiplexer (116). This prevents the overwriting of the previous pixel line with the next pixel line display signal. However, by this method, display errors may occur when the delay time of the gate line driving signal is large.

In the display apparatus of Patent Document 2, a gate clock generating portion (400) for generating clock signals for driving the gate line driving circuit detects the delay time of a gate line driving signal (Von), and narrows the pulse widths of clock signals (CKV, CKVB) according to the delay time (FIG. 2). Then, the pulse width of the gate line driving signal is made approximately equal to one horizontal scanning period (1H), and this prevents the overwriting of the pixels with the next pixel line display signal. However, when the pulse widths of the clock signals are narrowed, their driving abilities are lowered, and the operational margin of the gate line driving circuit is lowered.

In the display apparatus of Patent Document 3, the delay time of the gate line driving signal is detected, and according to the delay time, a timing adjusting circuit (31) delays a control signal (LTHXU) for a latch circuit (13) that defines the timing of sending the display signal to a D/A converter (FIG. 9). This prevents the overwriting of pixels with the next pixel line display signal, but, like Patent Document 1, display errors may occur when the delay time of the gate line driving signal is large. Also, the costs of the display apparatus are increased because the circuit that detects the delay time of the gate line driving signal is provided outside of the display apparatus.

In this way, for conventional display apparatuses, it was difficult to prevent display errors while ensuring operational margin when the delay time of the gate line driving signal is large.

SUMMARY OF THE INVENTION

For an image display apparatus, a first object of the present invention is to prevent display errors while ensuring operational margin even when the delay time of gate line driving signals is large. A second object is to enable cost reduction by integrating a level shifter that supplies control signals (a clock signal, start pulse, etc) to a gate line driving circuit together with pixels.

An image display apparatus according to a first aspect of the present invention includes a plurality of gate lines, a plurality of data lines intersecting with the plurality of gate lines, a plurality of pixels formed in the vicinities of the intersections of the plurality of gate lines and the plurality of data lines, and the following gate line driving circuit, source driver, and inactivation transition detecting circuit. The source driver has a latch circuit for holding display data for one pixel line and supplies a signal corresponding to the display data to the plurality of pixels through the data lines. The gate line driving circuit drives the plurality of pixels by sequentially activating the plurality of gate lines. The inactivation transition detecting circuit activates a detect signal for a certain period when detecting inactivation of each of the plurality of gate lines. The latch circuit updates held display data in response to the activation of the detect signal.

The latch circuit updates held display data in response to the detect signal that is activated when each of the plurality of gate lines is inactivated. Accordingly, even when the gate line driving signals are delayed, the display signal sent to the pixels is updated after the inactivation of the gate lines. Accordingly, erroneous write of the display signal is surely prevented even when the delay of the gate line driving signals is large.

An image display apparatus according to a second aspect of the present invention includes a plurality of gate lines, a plurality of data lines intersecting with the plurality of gate lines, a plurality of pixels formed in the vicinities of the intersections of the plurality of gate lines and the plurality of data lines, and the following gate line driving circuit, source driver, inactivation transition detecting circuit, and controller. The source driver has a latch circuit for holding display data for one pixel line and supplies a signal corresponding to the display data to the plurality of pixels through the data lines. The gate line driving circuit drives the plurality of pixels by sequentially activating the plurality of gate lines. The inactivation transition detecting circuit activates a detect signal for a certain period when detecting inactivation of each of the plurality of gate lines. The controller outputs a clock signal and a start pulse for driving the gate line driving circuit. The controller includes a counter that measures a delay time of a timing of activation of the detect signal with respect to a timing of updating of the display data held in the latch circuit, and a timing controller that controls timings of activation of the clock signal and the start pulse on the basis of the delay time.

The controller controls the timings of activation of the clock signal and start pulse according to the detect signal that is activated when each of the plurality of gate lines is inactivated. Accordingly, even when the gate line driving signals are delayed, the delay time can be corrected such that the display signal sent to pixels is updated when the gate lines are inactivated. Accordingly, even when the delay of the gate line driving signals is large, erroneous write of the display signal is certainly prevented.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
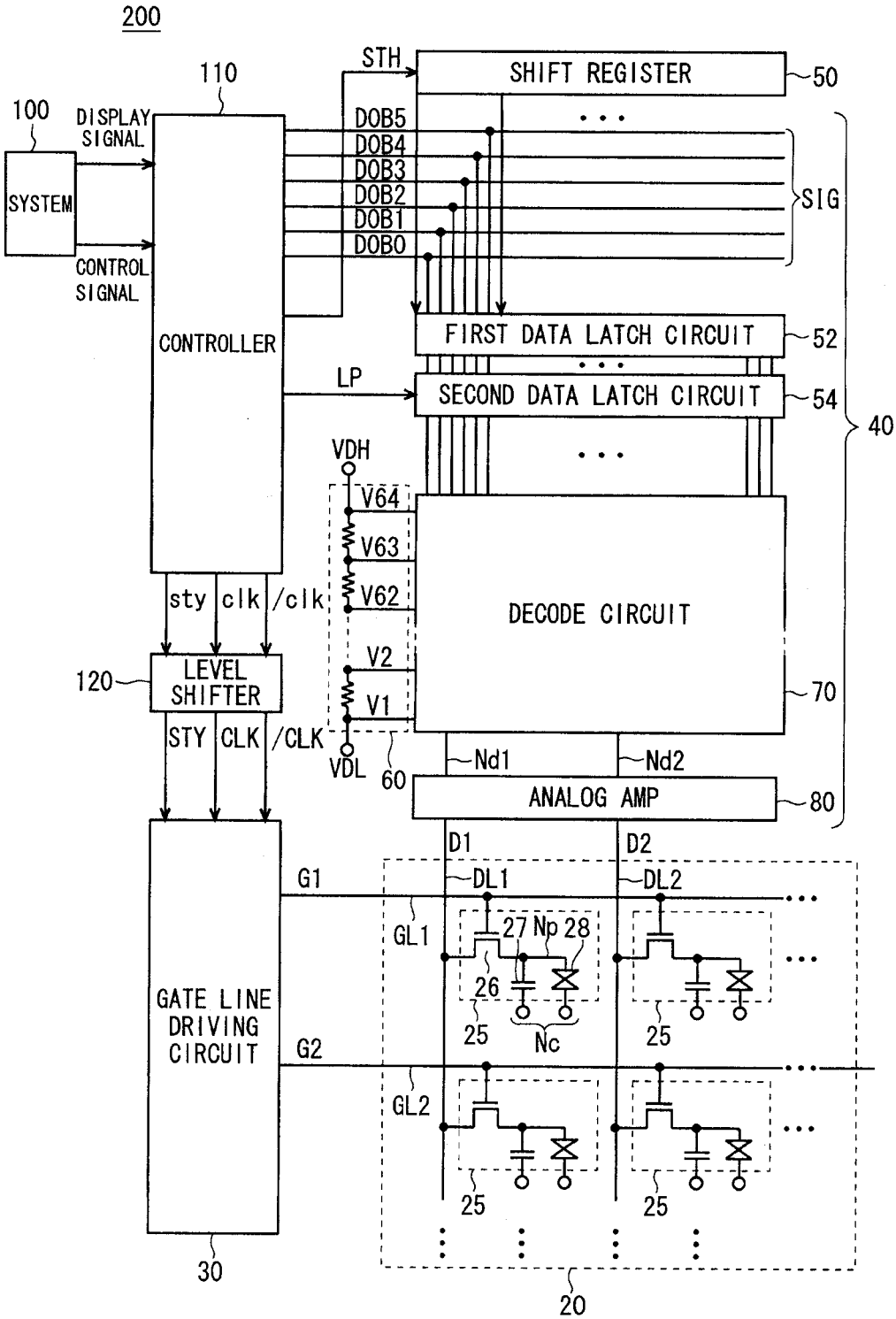
FIG. 1 is a schematic block diagram of a liquid-crystal display apparatus as a preliminary technique of the present invention.

Now, the preferred embodiments of the present invention will be described referring to the drawings. In order to avoid redundant repetitions of description, elements having the same or corresponding functions are shown with the same reference characters in the drawings.

The transistors used in the preferred embodiments are insulated-gate field-effect transistors. In an insulated-gate field-effect transistor, the electric conductivity between the drain region and source region in the semiconductor layer is controlled by the electric field in the gate insulating film. The material of the semiconductor layer in which the drain region and source region are formed can be amorphous silicon, microcrystal silicon, organic semiconductor like pentacene, or oxide semiconductor like IGZO (In—Ga—Zn—O), for example.

As is well known, a transistor is an element that has at least three electrodes including a control electrode (a gate (electrode) in a narrow sense), one current electrode (a drain (electrode) or a source (electrode) in a narrow sense), and the other current electrode (a source (electrode) or a drain (electrode) in a narrow sense). A transistor functions as a switching element in which a channel is formed between the drain and source when a given voltage is applied to the gate. The drain and the source of a transistor are structured basically the same, and their names are changed according to the applied voltage condition. For example, with an N-type transistor, an electrode of a relatively higher potential (hereinafter also referred to as "level") is referred to as a drain, and an electrode with a lower potential is referred to as a source (a P-type transistor has the opposite relation).

Unless specifically noted, such transistors may be ones formed on a semiconductor substrate, or may be thin-film transistors (TFTs) formed on an insulating substrate such as glass. Substrates on which transistors are formed may also be single crystal substrates, or insulating substrates such as SOI, glass, resin, etc.

The display apparatus of the present invention is formed by using transistors of a single conductivity type, and enhancement mode (normally off) and depletion mode (normally on) transistors are used. Depletion mode transistors are used not as switching elements but as current driving elements, and hereinafter, unless specifically noted, "transistor" means an enhancement mode transistor. First, an N-type transistor goes into an active state (on state, conducting state) when the gate-source voltage goes to H (High) level higher than the threshold voltage of that transistor, and goes into an inactive state (off state, non-conducting state) at L (Low) level lower than the threshold voltage. Accordingly, in a circuit using N-type transistors, H level of a signal is an "active level", and L level is an "inactive level". Also, a node in a circuit using N-type transistors is charged to H level and a change from an inactive level to active level occurs, and it is discharged to L level and a change from an active level to inactive level occurs.

On the other hand, a P-type transistor goes into an active state (on state, conducting state) when the gate-source voltage goes to L level lower than the threshold voltage of the transistor (a negative value based on the source), and goes into an inactive state (off state, non-conducting state) at H level higher than the threshold voltage. Accordingly, in a circuit using P-type transistors, L level of a signal is an "active level", and H level is an "inactive level". Also, the charging and discharging relations of nodes in a circuit using P-type transistors are opposite to those of N-type transistors, and they are charged to L level and a change from an inactive level to active level occurs, and discharged to H level and a change from an active level to inactive level occurs.

In this specification, a change from an inactive level to an active level is defined as "pull up", and a change from an active level to an inactive level is defined as "pull down". That is, in a circuit using N-type transistors, a change from L level to H level is defined as "pull up", and a change from H level to L level is defined as "pull down", and in a circuit using P-type transistors, a change from H level to L level is defined as "pull up", and a change from L level to H level is defined as "pull down".

Also, in this specification, "connect" between two elements, two nodes, or one element and one node includes connections that are made through another component (an element, switch, etc.) but that are substantially equivalent to direct connection. For example, even when two elements are connected through a switch, the two elements are represented as "connected" when they can function in the same way as when they are directly connected.

<Preliminary Technique of the Present Invention>

FIG. 1 is a schematic block diagram for illustrating the configuration of a display apparatus as a preliminary technique of the present invention, and FIG. 1 shows the overall configuration of a liquid-crystal display apparatus 200 as a typical example of a display apparatus.

The liquid-crystal display apparatus 200 includes a controller 110, a level shifter 120, a liquid-crystal array portion 20, a gate line driving circuit (scanning line driving circuit) 30, and a source driver 40. The source driver 40 includes a shift register 50, first and second data latch circuits 52 and 54, a gray scale voltage generating circuit 60, a decode circuit 70, and an analog amp 80. The system 100 is a system like a portable device, for example, and it supplies a display signal and various control signals to the controller 110.

On the basis of the display signal and control signals received from the system 100, the controller 110 generates a horizontal direction start pulse STH for controlling the shift register 50 of the source driver 40, a latch signal LP for controlling the second data latch circuit 54, and 6-bit display signal D0B0 to D0B5. It also generates a vertical direction start pulse sty for driving the gate line driving circuit 30, and two clock signals clk and /clk that are complementary to each other (the active periods do not overlap).

The level shifter 120 is a level converter circuit that converts the small-amplitude vertical direction start pulse sty and clock signals clk, /clk outputted from the controller 110 into signals at levels that can drive the gate line driving circuit 30 (a vertical direction start pulse STY, and clock signals CLK, /CLK).

The liquid-crystal array portion 20 includes a plurality of pixels 25 arranged in a matrix. Gate lines $GL_1$, $GL_2$, . . . (collectively referred to as "gate lines GL") are provided respectively for the rows of pixels (hereinafter also referred to as "pixel lines"), and data lines $DL_1$, $DL_2$, . . . (collectively referred to as "data lines DL") are provided respectively for the columns of pixels (hereinafter also referred to as "pixel columns"). As examples thereof, FIG. 1 shows gate lines $GL_1$ and $GL_2$ corresponding to the first and second pixel lines, data lines $DL_1$ and $DL_2$ corresponding to the first and second pixel columns, and four pixels 25 arranged at their intersections.

Each pixel 25 includes a pixel switch element 26 provided between the corresponding data line DL and a pixel node Np, and a capacitor 27 and a liquid-crystal display element 28 connected in parallel between the pixel node Np and common electrode node NC. The orientation of the liquid crystal in the liquid-crystal display element 28 changes according to the voltage difference between the pixel node Np and common electrode node NC, and the display luminance of the liquid-crystal display element 28 changes in response. Thus, it is possible to control the luminance of each pixel according to the display voltage transmitted to the pixel node Np through the data line DL and pixel switch element 26. That is, intermediate luminance can be obtained as an intermediate voltage difference between the voltage difference corresponding to the maximum luminance and the voltage difference corresponding to the minimum luminance is applied between the pixel node Np and the common electrode node NC. Thus, levels of luminance can be obtained by setting the display voltage at levels.

The gate line driving circuit 30 generates gate line driving signals $G_1$, $G_2$, . . . (collectively referred to as "gate line driving signals G") for driving the gate lines $GL_1$, $GL_2$, . . . . The gate line driving signals G are sequentially activated on the basis of a given scanning cycle, and thus the gate lines GL are sequentially selected. The gate electrodes of the pixel switch elements 26 are connected respectively to the corresponding gate lines GL. While a particular gate line GL is being selected, the pixel switch elements 26 of the pixels connected thereto are conductive and the pixel nodes Np are connected to the corresponding data lines DL. Then, the display voltage transmitted to the pixel node Np is held in the capacitor 27. Generally, the pixel switch elements 26 are formed of TFTs formed on the same insulating substrate (glass substrate, resin substrate, etc.) with the liquid-crystal display elements 28.

To the data lines DL, the source driver 40 outputs display voltage that is set at levels by the display signal SIG as an N-bit digital signal. Herein, as an example, the display signal SIG is a 6-bit signal and formed of display signal bits D0B0 to D0B5. On the basis of the 6-bit display signal SIG, for each pixel, $2^6$=64 levels of gray scale display are possible. Furthermore, when one color display unit is formed of three pixels of R (Red), G (Green) and B (Blue), color display of about 260,000 colors is possible.

In the display signal SIG outputted from the controller 110, the display signal bits D0B0 to D0B5 corresponding to the display luminance of each pixel 25 are serially generated. That is, the display signal bits D0B0 to D0B5 at each timing indicate the display luminance in one pixel 25 in the liquid-crystal array portion 20.

Also, the controller 110 activates the horizontal direction start pulse STH inputted to the shift register 50 of the source driver 40 according to the cycle of one horizontal scanning period of the display signal SIG. Each time the horizontal direction start pulse STH is activated, the shift register 50 instructs the first data latch circuit 52 to capture the display signal bits D0B0 to D0B5 with a timing synchronized with the cycle of switching of the setting of the display signal SIG. The first data latch circuit 52 sequentially captures the serially generated display signal SIG and holds a display signal SIG for one pixel line.

The latch signal LP inputted to the second data latch circuit 54 is activated with the timing by which the display signal SIG for one pixel line is captured into the first data latch circuit 52. In response, the second data latch circuit 54 captures the display signal SIG for one pixel line that is held in the first data latch circuit 52 at that time. That is to say, the second data latch circuit 54 updates held data in response to the activation of the latch signal LP.

The gray scale voltage generating circuit 60 is formed of 63 voltage-dividing resistors connected in series between high voltage VDH and low voltage VDL and generates 64 levels of gray scale voltages V1 to V64.

The decode circuit 70 decodes the display signal SIG held in the second data latch circuit 54. On the basis of the results of decoding, the decode circuit 70 selects display voltages from among the gray scale voltages V1 to V64, and outputs them to the decode output nodes $Nd_1$, $Nd_2$, . . . (collectively referred to as "decode output nodes Nd").

As a result, display voltages (one of the gray scale voltages V1 to V64) corresponding to the display signal SIG for one pixel line held in the second data latch circuit 54 are simultaneously (in parallel) outputted to the decode output nodes Nd. FIG. 1 shows the decode output nodes $Nd_1$ and $Nd_2$ corresponding to the first and second data lines $DL_1$ and $DL_2$ as examples.

The analog amp 80 generates display signals $D_1$, $D_2$, . . . (collectively referred to as "display signals D") by amplifying the analog voltages corresponding to the display voltages outputted from the decode circuit 70 to the decode output nodes $Nd_1$, $Nd_2$, . . . , and outputs them to the data lines $DL_1$, $DL_2$, . . . .

On the basis of a given scanning cycle, the source driver 40 repeatedly outputs display signals D corresponding to the series of display signals SIG to the data lines DL, one pixel line at a time, and the gate line driving circuit 30 sequentially drives the gate lines GL in synchronization with the scanning cycle, whereby the liquid-crystal array portion 20 displays images based on the display signal SIG.

For display apparatuses as shown in FIG. 1, some display apparatuses are commercially available in which the pixel array portion 20, controller 110, source driver 40, level shifter 120, and gate line driving circuit 30 are integrated together in order to reduce manufacturing costs. However, as the display speed is increased as the resolution of the display apparatus is enhanced, integrating all such circuits together rather leads to increased costs, and practical use of such apparatuses becomes difficult. With current common techniques, the costs of display apparatuses can be easily reduced by only integrating the liquid-crystal array portion 20 and the gate line driving circuit 30. Particularly, costs can be reduced most easily by forming the liquid-crystal array portion 20 and the gate line driving circuit 30 with transistors of the same conductivity type.

In the present invention, the liquid-crystal array portion 20 and the gate line driving circuit 30, and also the level shifter 120, are integrated together, and the costs of the display apparatus are reduced at the same time. Particularly, the manufacturing costs can be reduced by forming the liquid-crystal array portion 20, gate line driving circuit 30, and level shifter 120 with transistors of the same conductivity type. Level shifters formed only of transistors of the same conductivity type include those disclosed in Japanese Patent Application Laid-Open Nos. 2005-12356 and 2009-188594 by the inventor of the present invention, for example.

Usually, low-cost display apparatuses can be easily realized by using a-Si (amorphous silicon) TFTs as the pixel switch elements 26 of the liquid-crystal array portion 20. However, the operating speed of a-Si TFTs is slow. Accordingly, when they are used in the level shifter 120, the vertical direction start pulse STY and clock signals CLK, /CLK that the level shifter 120 supplies to the gate line driving circuit 30 are delayed. As a result, the gate line driving signals G outputted from the gate line driving circuit 30 to the gate lines GL are considerably delayed behind the display signals D outputted from the source driver 40 to the data lines DL, and then the display signal for the next pixel line will be erroneously written in the currently selected pixel line. The present invention provides a low-cost display apparatus in which the problem of the delay of the level shifter 120 is solved, and in which the liquid-crystal array portion 20, gate line driving circuit 30, and level shifter 120 are integrated together.

First Preferred Embodiment

Figure 2:
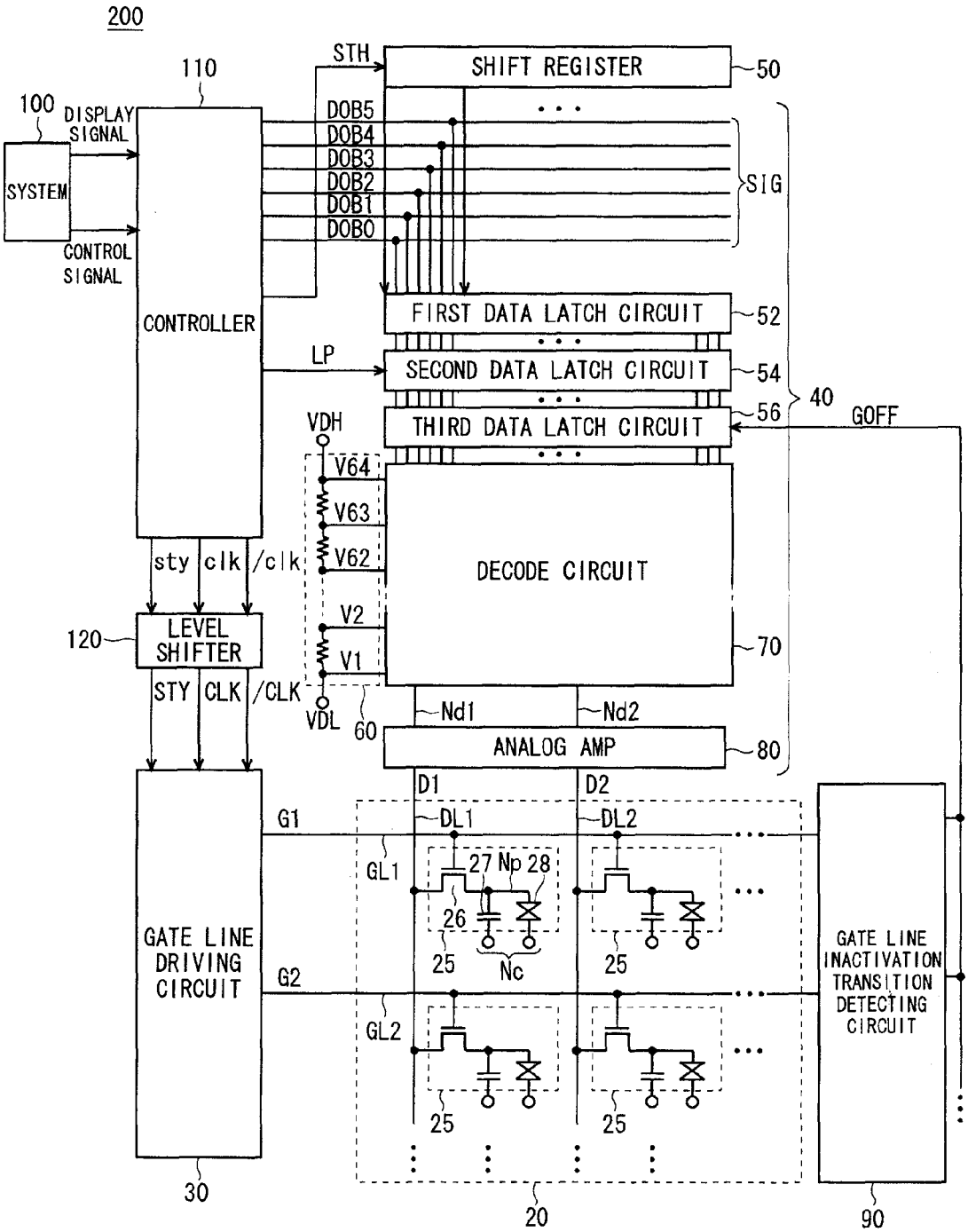
FIG. 2 is a schematic block diagram of a liquid-crystal display apparatus according to a first preferred embodiment.

FIG. 2 is a schematic block diagram of a liquid-crystal display apparatus 200 according to a first preferred embodiment of the present invention. As compared with the configuration of FIG. 1, this liquid-crystal display apparatus 200 includes a gate line inactivation transition detecting circuit 90 at the ends of the gate lines GL opposite to the ends connected to the gate line driving circuit 30, and a third data latch circuit 56 is provided between the second data latch circuit 54 and the decode circuit 70.

The gate line inactivation transition detecting circuit 90 has a function of detecting inactivation of each gate line GL (a fall of each gate line driving signal G), and outputs a detect signal GOFF that is activated with the timing of inactivation of each gate line GL.

The third data latch circuit 56 has the same function as the second data latch circuit 54, and the above-described detect signal GOFF is used as a latch signal for the third data latch circuit 56. That is to say, the third data latch circuit 56 captures and holds the display signal SIG (display data) for one pixel line being held in the second data latch circuit 54 when the detect signal GOFF is activated. Accordingly, the data held by the third data latch circuit 56 is updated in response to the activation of the detect signal GOFF.

The operation of the liquid-crystal display apparatus 200 of FIG. 2 will be described. Here, it is assumed that the level shifter 120 is formed by using a-Si TFTs, and the vertical direction start pulse STY and clock signals CLK, /CLK are delayed, and the gate line driving signals G are also delayed.

Figure 3:
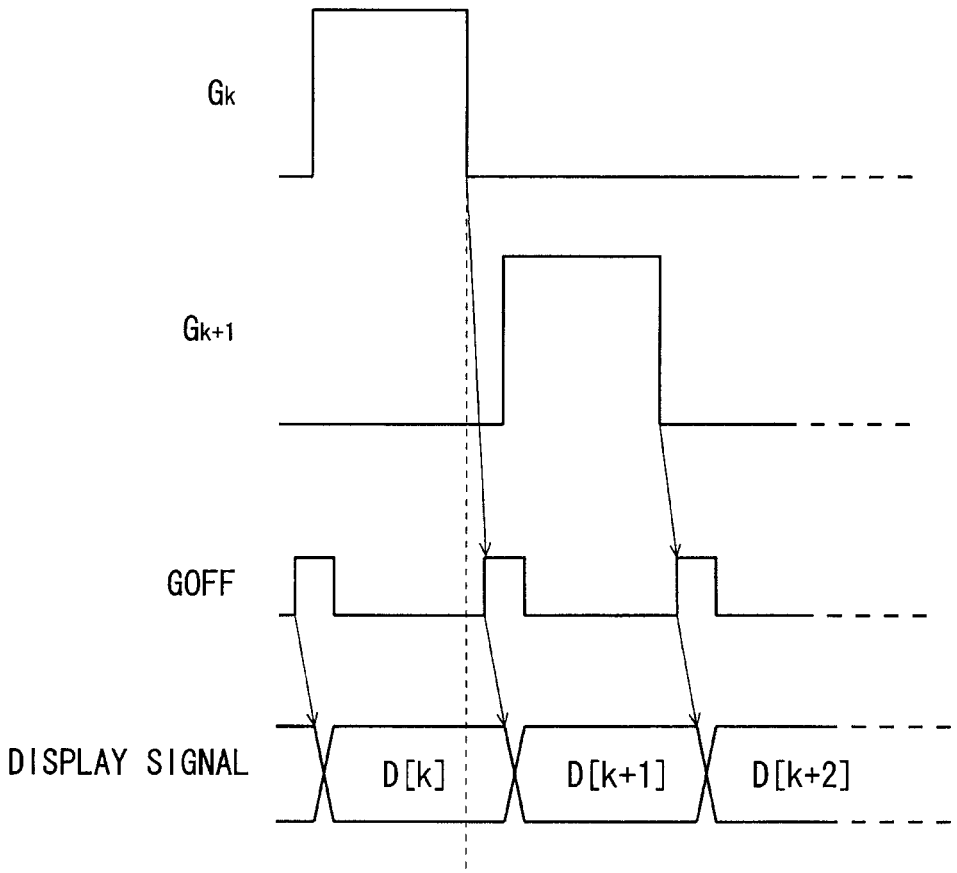
FIG. 3 is a signal waveform diagram for illustrating the operation of the liquid-crystal display apparatus according to the first preferred embodiment.

FIG. 3 is a signal waveform diagram for illustrating the operation of the liquid-crystal display apparatus 200 of FIG. 2. As examples, FIG. 3 shows a gate line driving signal $G_k$ for driving the kth gate line $GL_k$ and a gate line driving signal $G_{k+1}$ for driving the next ((k+1)th) gate line $GL_{k+1}$ that are sequentially activated. The gate line inactivation transition detecting circuit 90 activates the detect signal GOFF with timings of inactivation of the gate line driving signals $G_1$, $G_2$, . . . . That is to say, as shown in FIG. 3, the detect signal GOFF is activated when the gate line driving signals $G_k$, $G_{k+1}$ change from H level (active level) to L level (inactive level).

The third data latch circuit 56 captures the display signal SIG that is held in the second data latch circuit 54 with the timing of rise of the detect signal GOFF, i.e. with the timing of fall of the gate line driving signal. $G_k$. Since the gate line driving signal $G_k$ is delayed, the second data latch circuit 54 already holds the display signal SIG for the (k+1)th line when the gate line driving signal $G_k$ falls. Accordingly, when the gate line driving signal $G_k$ falls, the display signal SIG for the (k+1)th line is captured into the decode circuit 70, and the display signal D for the (k+1)th line is outputted to the data lines DL through the decode circuit 70 and the analog amp 80.

Thus, according to the liquid-crystal display apparatus 200 of this preferred embodiment, even when the gate line driving signal $G_k$ is delayed and the display signal SIG held in the second data latch circuit 54 changes to that for the (k+1)th line during the active period of the gate line driving signal $G_k$ (the select period of the gate line $GL_k$), the third data latch circuit 56 holds the display signal SIG for the kth line and supplies it to the decode circuit 70 until the gate line driving signal. $G_k$ falls. Accordingly, the display signals D supplied to the data lines DL are maintained to those for the kth line during the select period of the gate line $GL_k$. That is, it is possible to prevent the display signals D for the (k+1)th line from being erroneously written to the pixels of the gate line $GL_k$.

The problem of erroneously writing the display signals D does not occur even when the gate line driving signal $G_k$ is delayed, so that a level shifter 120 formed of a-Si TFTs can be used. Accordingly, it is easy to integrate it with liquid-crystal array portion 20 and gate line driving circuit 30 formed of a-Si TFTs, making it possible to further reduce costs.

First Modification

As described above, the configuration of FIG. 2 is effective when the delay of the gate line driving signals G is relatively large and the display signal SIG held in the second data latch circuit 54 changes to that for the (k+1)th line during the active period of the gate line driving signal $G_k$ (during the select period of the gate line $GL_k$). However, when the delay of the gate line driving signals G is relatively small, the second data latch circuit 54 might be still holding the display signal SIG for the kth line when the gate line driving signal $G_k$ falls. In this case, the third data latch circuit 56 will latch the display signal SIG for the kth line when the gate line driving signal $G_k$ falls, and then the display signals D for the kth line will be erroneously supplied to the data lines DL during the select period of the gate line $GL_{k+1}$.

Figure 4:
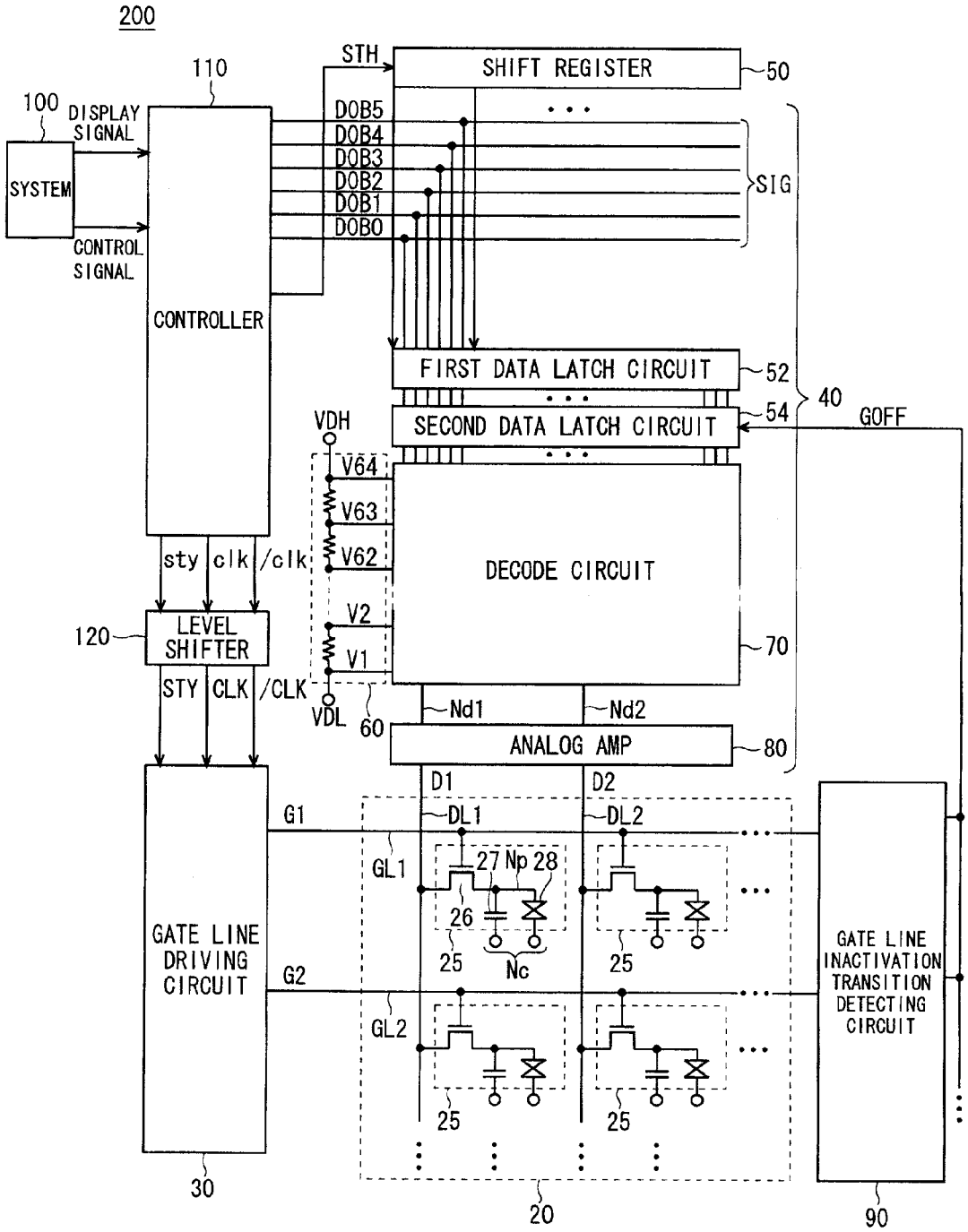
FIG. 4 is a schematic block diagram of a liquid-crystal display apparatus according to a first modification of the first preferred embodiment.

When the delay of the gate line driving signals G is relatively small, as shown in FIG. 4, without providing the third latch circuit 56, the detect signal GOFF outputted from the gate line inactivation transition detecting circuit 90 can be used as a latch signal for the second data latch circuit 54 (in other words, the second data latch circuit 54 in FIG. 2 is omitted).

Also with the configuration of FIG. 4, the timing by which the display signal SIG supplied to the decode circuit 70 is changed is adjusted according to the delay of the gate line driving signals G, and the problem of display errors due to the delay of the gate line driving signals G is solved. As compared with the configuration of FIG. 2, this configuration cannot be applied when the delay of the gate line driving signals G is large, but this configuration is effective in that the problem described above is avoided when the delay of the gate line driving signals G is relatively small.

Second Modification

The liquid-crystal display apparatus 200 of FIG. 2 needs a large circuit area because gate line inactivation transition detecting circuits must be provided for all gate lines GL. This modification shows an example that can suppress the increase of the circuit area of the liquid-crystal display apparatus 200.

Figure 5:
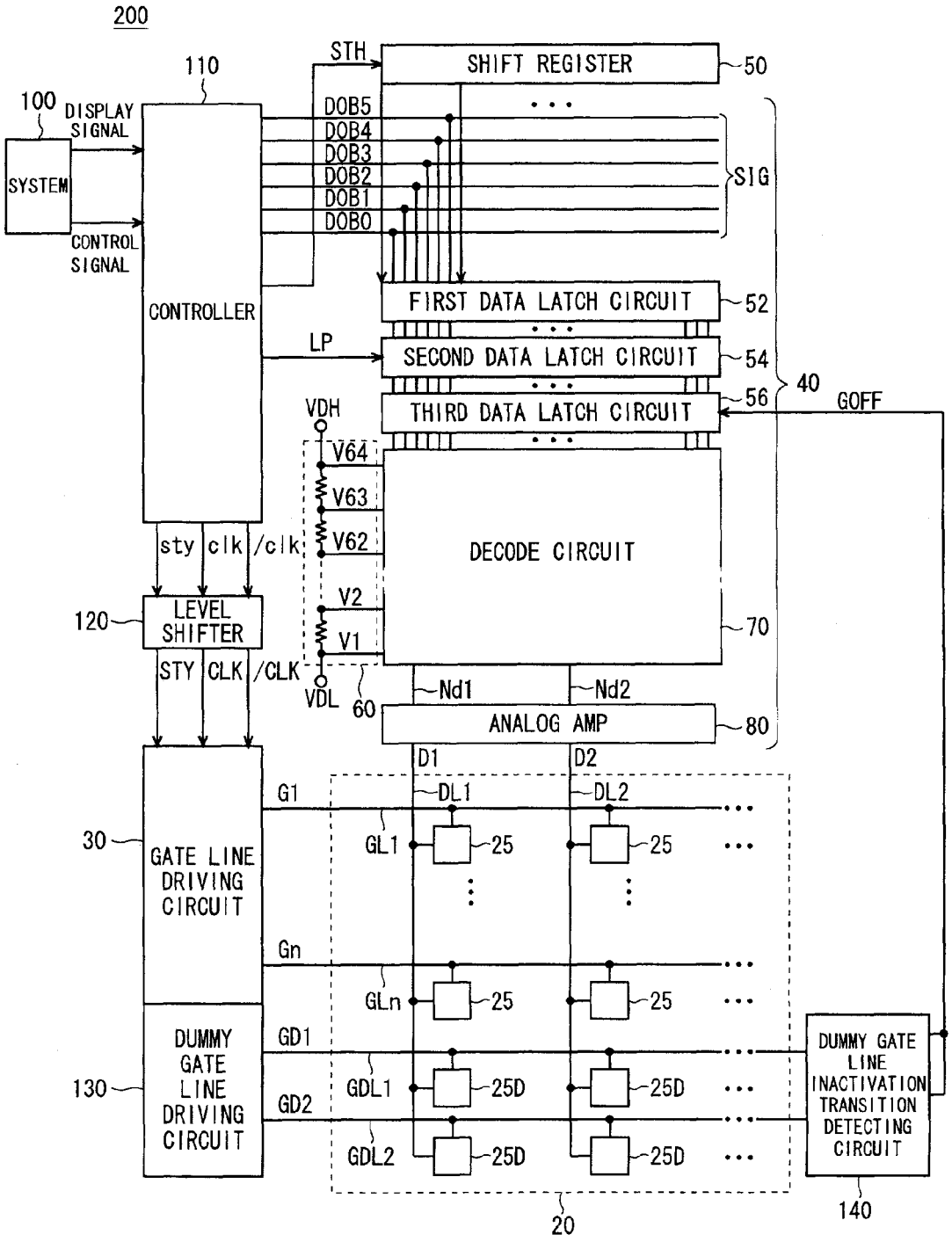
FIG. 5 is a signal waveform diagram for illustrating the operation of a liquid-crystal display apparatus according to a second modification of the first preferred embodiment.

FIG. 5 is a schematic block diagram of a liquid-crystal display apparatus 200 according to a second modification of the first preferred embodiment. As shown in FIG. 5, the liquid-crystal display apparatus 200 of this modification is different from the configuration of FIG. 2 in that the gate line inactivation transition detecting circuit 90 is not connected to the gate lines GL. In place of it, this liquid-crystal display apparatus 200 includes two dummy gate lines GDL1 and GDL2, a plurality of dummy pixels 25D connected to the dummy gate lines GDL1 and GDL2, a dummy gate line driving circuit 130 for driving the dummy gate lines GDL1 and GDL2, and a dummy gate line inactivation transition detecting circuit 140 connected to the ends of the dummy gate lines GDL1 and GDL2 opposite to the ends connected to the dummy gate line driving circuit 130.

The dummy gate lines GDL1 and GDL2 are structured the same as the normal gate lines GL and have the same width and length. Also, the dummy pixels 25D are structured the same as the normal pixels 25. The number of dummy pixels 25D connected to each of the dummy gate lines GDL1 and GDL2 is the same as the number of pixels 25 connected to each of the normal gate lines GL. As a result, the signal propagation delay time of each of the dummy gate lines GDL1 and GDL2 is the same as that of the normal gate lines GL.

The dummy gate line driving circuit 130 generates dummy gate line driving signals GD1 and GD2 for respectively driving the dummy gate lines GDL1 and GDL2. The dummy gate line inactivation transition detecting circuit 140 detects inactivation of the dummy gate lines GDL1 and GDL2 (i.e. falls of the dummy gate line driving signals GD1 and GD2), and supplies the third data latch circuit 56 with a detect signal GOFF that is activated with those timings.

The dummy pixels 25D shown in FIG. 5 are connected to the data lines DL, but it is not necessary to supply display signals $D_1$, $D_2$, . . . to them, since the dummy pixels 25D are not used for display of images. Accordingly, it is not always necessary to connect the current electrodes of the pixel switch elements (not shown) of the dummy pixels 25D to the data lines DL but they may be fixed at constant potential, for example.

Figure 6:
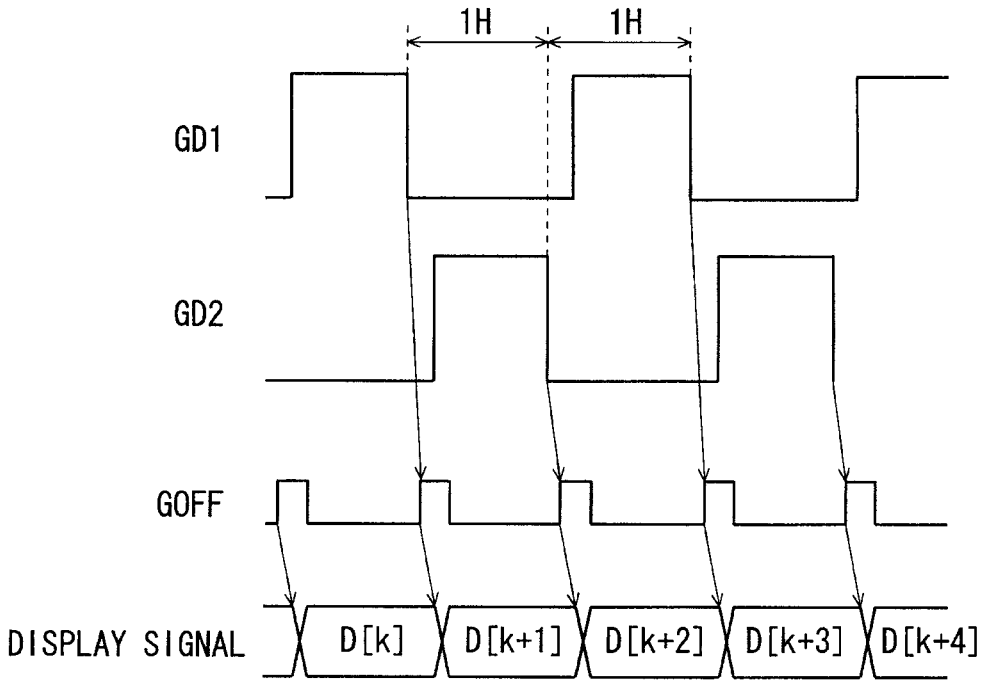
FIG. 6 is a signal waveform diagram for illustrating the operation of the liquid-crystal display apparatus according to the second modification of the first preferred embodiment.

FIG. 6 is a signal waveform diagram for illustrating the operation of the liquid-crystal display apparatus 200 of FIG. 5. The dummy gate line driving circuit 130 operates to alternately activate the dummy gate line driving signals GD1 and GD2 for each one horizontal scanning period (1H) with a timing synchronized with the gate line driving signals G outputted from the gate line driving circuit 30 (which will be fully described later). Then, the dummy gate line inactivation transition detecting circuit 140 activates the detect signal GOFF according to the timings of inactivation of the dummy gate line driving signals GD1 and GD2 (falling timings). As a result, as shown in FIG. 6, the waveform of the detect signal GOFF is like that of the configuration of FIG. 2 (FIG. 3).

Thus, like the liquid-crystal display apparatus 200 of FIG. 2, this modification also prevents display errors due to the delay of the gate line driving signal $G_k$. Also, the increase of the circuit area is suppressed because the dummy gate line inactivation transition detecting circuit 140 connected only to the two dummy gate lines GDL1 and GDL2 is used in place of the gate line inactivation transition detecting circuit 90 connected to all gate lines GL.

While the dummy gate line driving circuit 130 will be described later, the gate line driving circuit 30 will be described before that for the sake of convenience of description.

Figure 7:
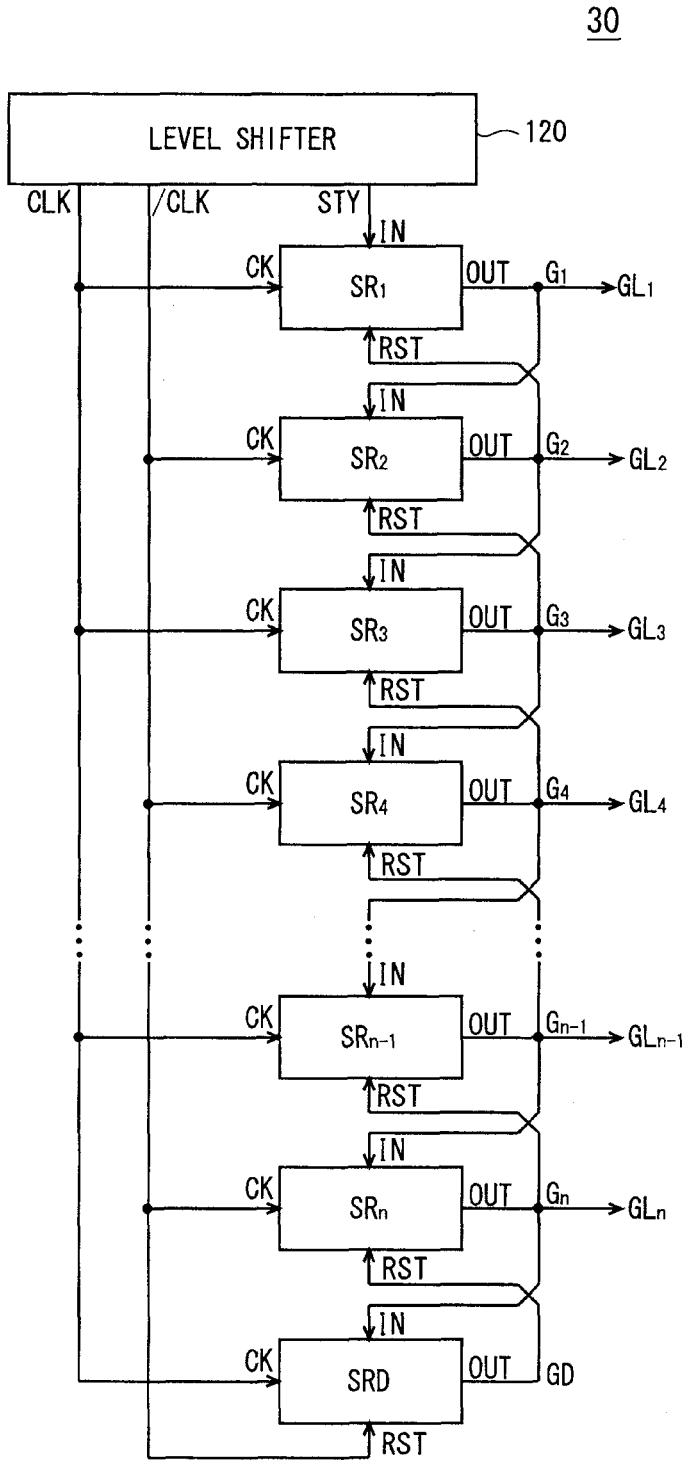
FIG. 7 is a configuration diagram of a gate line driving circuit.

FIG. 7 is a diagram illustrating the configuration of the gate line driving circuit 30. The gate line driving circuit 30 is formed of a multi-stage shift register including a plurality of cascade-connected unit shift registers $SR_1$, $SR_2$, . . . (collectively referred to as "unit shift registers SR"). A unit shift register SR is provided for one gate line GL.

In the gate line driving circuit 30 of FIG. 7, a dummy unit shift register SRD (hereinafter referred to as "a dummy stage") not connected to a gate line is provided in the stage next to the final-stage unit shift register $SR_n$. The dummy stage SRD is configured the same as the normal unit shift registers SR.

Each unit shift register SR has an input terminal IN, an output terminal OUT, a clock terminal CK, and a reset terminal RST. As shown in FIG. 7, the clock terminal CK of each unit shift register SR is supplied with one of the clock signals CLK and /CLK outputted from the level shifter 120. Specifically, the clock signal CLK is supplied to the unit shift registers $SR_1$, $SR_3$, $SR_5$, . . . in the odd-numbered stages, and the clock signal /CLK is supplied to the unit shift registers $SR_2$, $SR_4$, $SR_6$, . . . in the even-numbered stages.

In the example of FIG. 7, the unit shift register $SR_n$ in the final nth stage is an even-numbered stage, and the clock signal /CLK is supplied to that unit shift register $SR_n$. Accordingly, the dummy stage SRD is an odd-numbered stage, and the clock signal CLK is supplied to its clock terminal CK.

The input terminal IN of the unit shift register $SR_1$ in the first stage is supplied with the vertical direction start pulse STY outputted from the level shifter 120. In the second and following stages, the input terminal IN of the unit shift register SR is connected to the output terminal OUT of the unit shift register SR in the previous stage.

The vertical direction start pulse STY is a signal for causing the gate line driving circuit 30 to start signal shift operation, and it is activated with a timing corresponding to the start of each frame period of the display signal SIG. However, in this preferred embodiment, the vertical direction start pulse STY is also delayed due to the level shifter 120.

The reset terminal RST of each unit shift register SR is connected to the output terminal OUT of the unit shift register SR in the next stage. The reset terminal RST of the unit shift register $SR_n$ in the final stage is connected to the output terminal OUT of the dummy stage SRD. The reset terminal RST of the dummy stage SRD is supplied with the clock signal /CLK having a different phase from the clock signal CLK inputted to its clock terminal CK.

In this way, the gate line driving signal G outputted from the output terminal OUT of each unit shift register SR is supplied to the corresponding gate line GL as a vertical scanning pulse, and also supplied to the input terminal IN of the next stage and the reset terminal RST of the previous stage.

Figure 8:
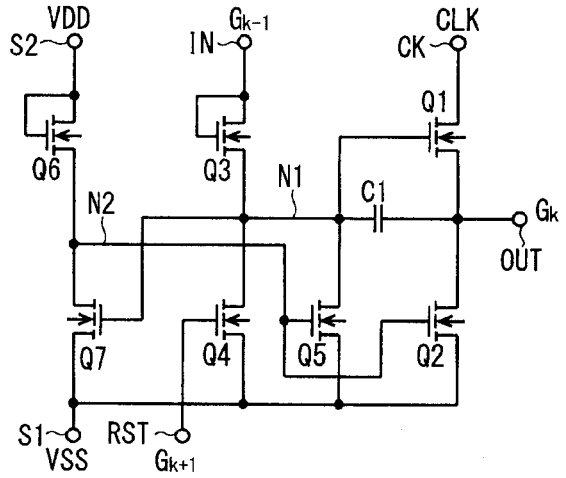
FIG. 8 is a circuit diagram of a unit shift register that forms the gate line driving circuit.

FIG. 8 is a circuit diagram illustrating an example of the configuration of the unit shift registers SR. In the gate line driving circuit 30, the cascade-connected unit shift registers SR are all configured substantially the same, and so a unit shift register. $SR_k$ in the kth stage (corresponding to the kth pixel line) will be described as an example. In this preferred embodiment, the transistors forming the unit shift register $SR_k$ are all field-effect transistors of the same conductivity type, and they are all N-type TFTs in the preferred embodiments and modifications shown below.

As shown in FIG. 8, the unit shift register $SR_k$ has a first power-supply terminal S1 supplied with low-potential power-supply potential (low-side power-supply potential) VSS and a second power-supply terminal S2 supplied with high-potential power-supply potential (high-side power-supply potential) VDD, in addition to the input terminal IN, output terminal OUT, clock terminal CK, and reset terminal RST shown in FIG. 7. In practical use, a reference potential is set on the basis of the voltage of the display signal D written to pixels 25, and the high-side power-supply potential VDD is set to 17 V and the low-side power-supply potential VSS is set to −12V, for example.

As shown in FIG. 8, the unit shift register $SR_k$ is formed of transistors Q1 to Q7 and a capacitance element C1 described below. The transistor Q1 is connected between the output terminal OUT and the clock terminal CK. The transistor Q2 is connected between the output terminal OUT and the first power-supply terminal S1. The node to which the gate of the transistor Q1 connects is defined as "node N1", and the node to which the gate of the transistor Q2 connects is defined as "node N2".

The capacitance element C1 is connected between the gate and source of the transistor Q1 (i.e. between the output terminal OUT and the node N1). The capacitance element C1 is provided to step up the node N1 when charging the output terminal OUT. When the gate-channel capacitance of the transistor Q1 is sufficiently large, it can be substituted for the capacitance element C1, in which case the capacitance element C1 can be omitted.

The transistor Q3 is connected between the input terminal IN and the node N1, and its gate is connected to the input terminal IN (i.e. the transistor Q3 is diode-connected). The transistor Q4 is connected between the node N1 and the first power-supply terminal S1, and its gate is connected to the reset terminal RST. The transistor Q5 is connected between the node N1 and the first power-supply terminal S1, and its gate is connected to the node N2.

The transistor Q6 is connected between the node N2 and the second power-supply terminal S2, and its gate is connected to the second power-supply terminal S2 (i.e. the transistor Q6 is diode-connected). The transistor Q7 is connected between the node N2 and the first power-supply terminal S1, and its gate connects to the node N1.

The on-state resistance of the transistor Q7 is set sufficiently smaller than that of the transistor Q6, and the transistors Q6 and Q7 form a ratio-type inverter having the node N1 as an input end and the node N2 as an output end. That is, when the node N1 is at L level (when the transistor Q7 is off), the node N2 is kept at H level by the current of the transistor Q6, and when the node N1 is at H level (when transistor Q7 is on), the node N2 is discharged by the transistor Q7 to L level.

Next, the operation of the unit shift register $SR_k$ of FIG. 8 will be described. For the sake of simplicity of description, it is assumed that the clock signal CLK is inputted to the clock terminal CK of the unit shift register $SR_k$ (the unit shift registers SR in the odd-numbered stages in FIG. 7 correspond to this).

It is assumed that, in the initial state, the node N1 is at L level (VSS) and the node N2 is at H level (VDD-Vth) (this state is referred to as "a reset state"). In the reset state, the transistor Q1 is off and the transistor Q2 is on, and so the output terminal OUT (gate line driving signal $G_k$) is at L level, irrespective of the level of the clock signal CLK. That is, the gate line $GL_k$ is in a non-selected state.

From this state, when the gate line driving signal $G_{k-1}$ of the previous stage goes to H level (VDD), the transistor Q3 turns on and charges the node N1. At this time, the transistor Q5 is also on, but the on-state resistance of the transistor Q3 is set sufficiently lower than that of the transistor Q5, and so the node N1 goes to H level.

Then, the transistor Q7 turns on, and the node N2 goes to L level. In response, the transistor Q5 turns off, and the H level potential of the node N1 becomes VDD-Vth. In the state in which the node N1 is at H level and the node N2 is at L level in this way (this state is referred to as "a set state"), the transistor Q1 is on and the transistor Q2 is off.

After that, when the gate line driving signal $G_{k-1}$ of the previous stage returns to L level, the transistor Q3 turns off. However, the node N1 is maintained at H level in a floating state, and so the set state of the unit shift register $SR_k$ is still maintained.

In this state, when the clock signal. CLK goes to H level, the level rise is transmitted to the output terminal OUT through the transistor Q1 being in the on state, and the level of the gate line driving signal $G_k$ rises. At this time, the node N1 is stepped up by the capacitive coupling through the capacitance element C1 and the gate-channel capacitance of the transistor Q1. As a result, the transistor Q1 operates in non-saturation region, and the H level potential of the gate line driving signal $G_k$ becomes VDD, the same as the clock signal CLK.

When the gate line driving signal $G_k$ thus goes to H level, the gate line $GL_k$ goes into a selected state. At the same time, the unit shift register $SR_{k+1}$ in the next stage goes into a set state.

When the clock signal CLK returns to L level, the output terminal OUT is discharged through the transistor Q1 being in the on state, and the gate line driving signal $G_k$ goes to L level. The gate line $GL_k$ thus returns to a non-selected state. At the output terminal OUT, the gate line driving signal $G_k$ goes to L level nearly following the fall of the clock signal CLK. That is to say, the signal propagation delay time of the level shifter 120 and the time constant of discharging of the gate line GL are main factors of the falling delay time of the gate line driving signal G.

Next, when the clock signal /CLK goes to H level, the gate line driving signal $G_{k+1}$ of the next stage goes to H level, the transistor Q4 turns on, and the node N1 is discharged to L level. In response, the transistor Q7 turns off, and the node N2 goes to H level. That is to say, the unit shift register $SR_k$ returns to the reset state.

In the reset state, the transistor Q1 is off and the transistor Q2 is on, and so the gate line driving signal $G_k$ is maintained at L level with low impedance. The transistor Q5 turns on in the reset state and maintains the node N1 at L level with low impedance. This prevents malfunction of the unit shift register $SR_k$ in the reset state.

The operations described above are summarized as follows: the unit shift register SR configured as shown in FIG. 8 is in the reset state while the signal at the input terminal IN is not activated, and the transistor Q1 is off and the transistor Q2 is on in this period, and so the gate line driving signal G is maintained at L level (VSS) with low impedance. Then, when the signal at the input terminal IN is activated, the unit shift register SR is placed in the set state, and the transistor Q1 turns on and the transistor Q2 turns off. When the clock signal at the clock terminal CK is activated in this state, the gate line driving signal G is activated. After that, when the signal at the reset terminal RST is activated, the unit shift register SR returns to the reset state, and the transistor Q1 turns off and the transistor Q2 turns on, and the gate line driving signal G is maintained at L level (VSS) with low impedance.

Figure 9:
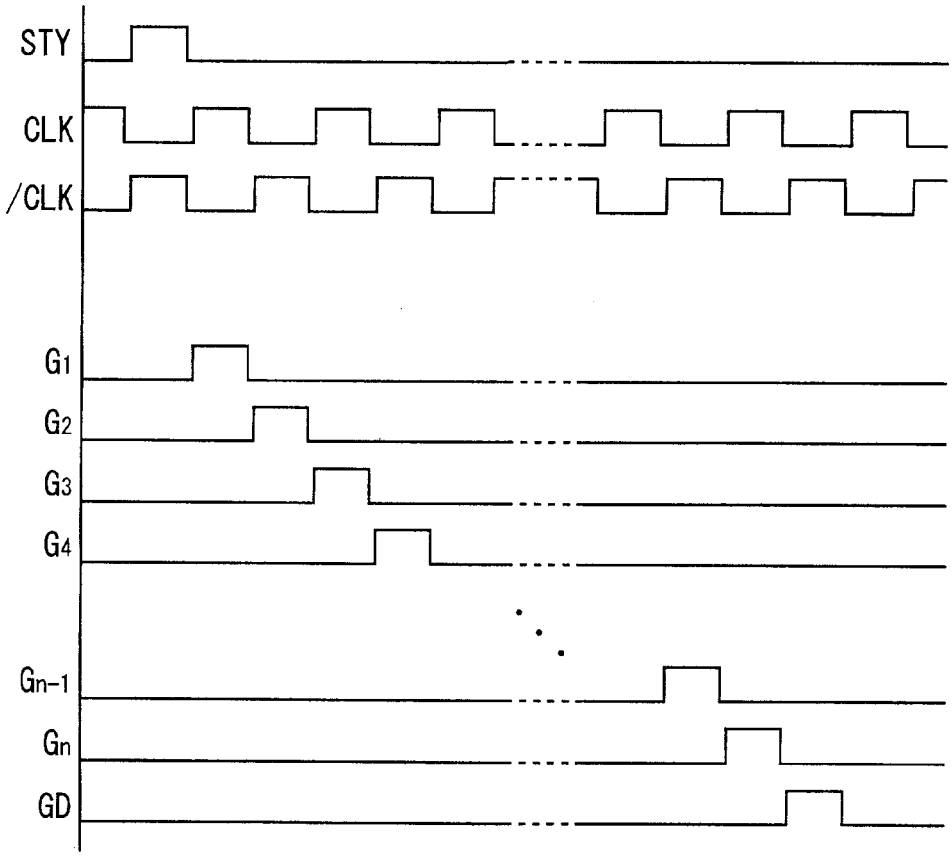
FIG. 9 is a signal waveform diagram illustrating the operation of the gate line driving circuit.

When a plurality of unit shift registers SR thus operating are cascade-connected as shown in FIG. 7 to form the gate line driving circuit 30, then, as shown in FIG. 9, with the activation of the vertical direction start pulse STY inputted to the unit shift register $SR_1$ in the first stage, the gate line driving signals $G_1$, $G_2$, $G_3$, . . . are activated in this order with a timing synchronized with the clock signals CLK and /CLK. Thus, the gate lines $GL_1$, $GL_2$, $GL_3$, . . . are sequentially selected according to a given scanning cycle.

In this example, the shift registers of the gate line driving circuit 30 are driven with two-phase clock signals, but they can be operated by using multi-phase clock signals of three or more phases.

Figure 10:
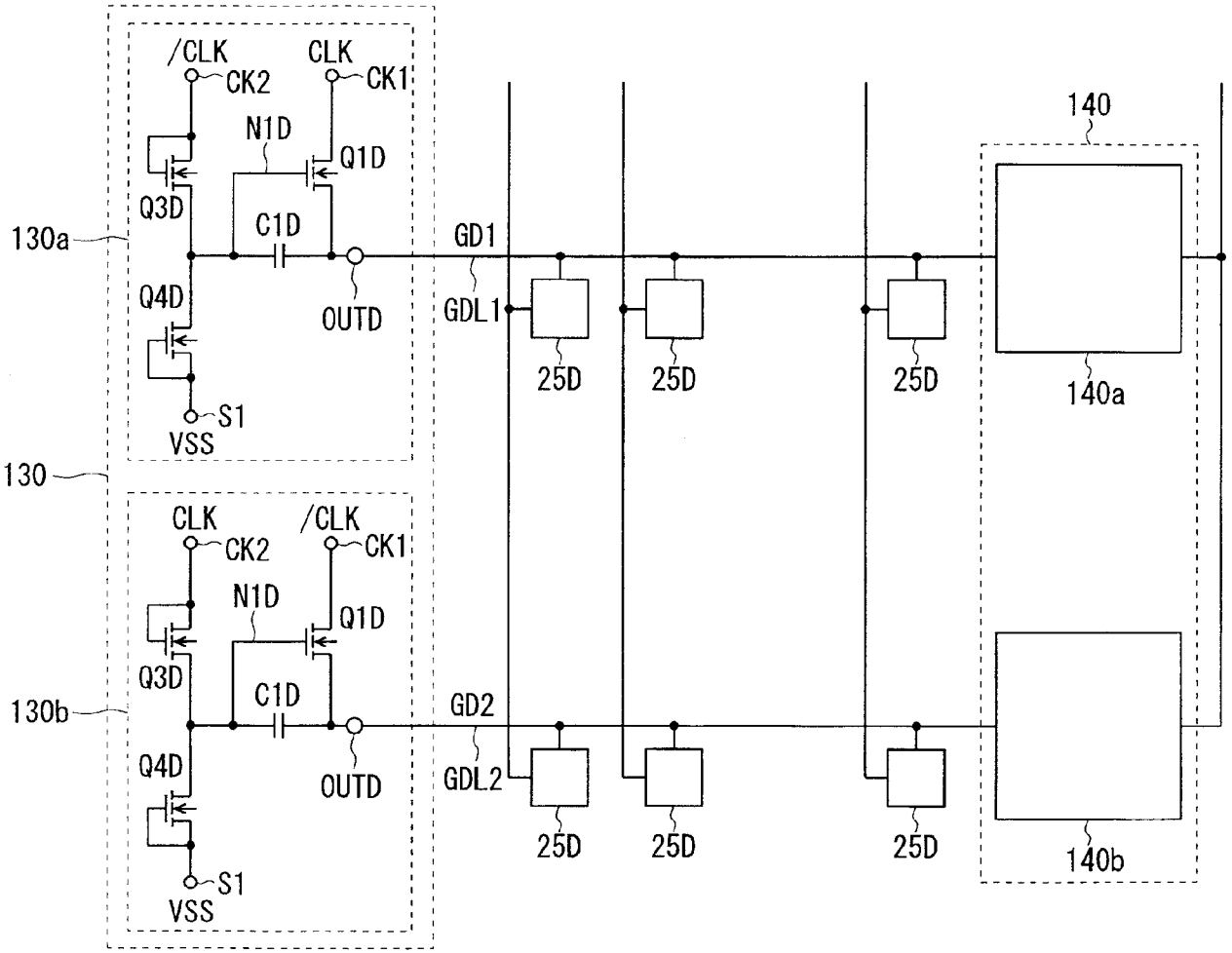
FIG. 10 is a configuration diagram of a dummy gate line driving circuit according to the second modification of the first preferred embodiment.

FIG. 10 is a diagram illustrating the configuration of the dummy gate line driving circuit 130. FIG. 10 shows an example configuration in which it is driven with two-phase clock signals CLK and /CLK in the same way as the gate line driving circuit 30. As shown in FIG. 10, the dummy gate line driving circuit 130 includes a first driving circuit 130*a* for driving the dummy gate line GDL1 and a second driving circuit 130*b* for driving the dummy gate line GDL2.

The dummy gate line inactivation transition detecting circuit 140 includes a first detecting circuit 140*a* for detecting a fall of the dummy gate line driving signal GD1 and activating the detect signal GOFF with that timing, and a second detecting circuit 140*b* for detecting a fall of the dummy gate line driving signal GD2 and activating the detect signal GOFF with that timing. The configuration of the first and second detecting circuits 140*a* and 140*b* will be described later.

The first driving circuit 130*a* outputs the dummy gate line driving signal GD1 from its output terminal OUT connected to the dummy gate line GDL1, and it is formed of transistors Q1D, Q3D, Q4D and a capacitance element C1D described below.

The transistor Q1D is connected between a first clock terminal CK1 and an output terminal OUTD. When the node to which the gate of the transistor Q1D connects is defined as "node N1D", the capacitance element C1D is connected between the node N1D and the output terminal OUTD. The capacitance element C1D is for stepping up the node N1D when charging the output terminal OUTD. When the gate-channel capacitance of the transistor Q1D is sufficiently large, it can be substituted for the capacitance element C1D, in which case the capacitance element C1D can be omitted.

The transistor Q3D is connected between a second clock terminal CK2 and the node N1D, and its gate is connected to the second clock terminal CK2. The transistor Q4D is connected between a first power-supply terminal S1 supplied with low-side power-supply potential VSS and the node N1D, and its gate is connected to the first power-supply terminal S1. That is, the transistor Q3D and the transistor Q4D are diode-connected. The transistor Q4D is always maintained in an off state.

The transistors Q1D, Q3D and the capacitance element C1D have the same dimensions as the transistors Q1, Q3 and the capacitance element C1 of the unit shift register SR of the gate line driving circuit 30. Also, the dimensions of the transistor Q4D are set such that the node N1D has the same parasitic capacitance as the node N1 of the unit shift register SR (FIG. 8).

The first driving circuit 130*a* and the second driving circuit 130*b* have the same circuit configuration, but opposite clock signals are inputted to the first and second clock terminals CK1 and CK2. That is to say, in the first driving circuit 130*a*, the clock signal CLK is inputted to the first clock terminal CK1 and the clock signal /CLK is inputted to the second clock terminal CK2, while, in the second driving circuit 130*b*, the clock signal /CLK is inputted to the first clock terminal CK1 and the clock signal CLK is inputted to the second clock terminal CK2.

The operation of the first driving circuit 130*a* will be described. When the clock signal /CLK goes to H level (VDD), the transistor Q3D turns on and the node N1D is charged to H level (VDD-Vth), and so the transistor Q1D turns on. After that, the clock signal /CLK goes to L level (VSS), but the transistor Q3D turns off and the charge of the node N1D is kept at the parasitic capacitance of the node N1D. Accordingly, the node N1D is kept at H level (VDD-Vth) and the on state of the transistor Q1D is also maintained.

Next, when the clock signal CLK is activated, the output terminal OUTD is charged through the transistor Q1D, and the dummy gate line driving signal GD1 goes to H level. At this time, due to the coupling through the capacitance element C1D and the gate-channel capacitance of the transistor Q1, the node N1D is stepped up and the transistor Q1D operates in non-saturation region. As a result, the H level potential of the dummy gate line driving signal GD1 becomes VDD, the same as the H level potential of the clock signal CLK.

After that, when the clock signal CLK goes to L level, the output terminal OUTD is discharged by the transistor Q1D being in the on state, and the dummy gate line driving signal GD1 goes to L level. At this time, the node N1D is stepped down by the coupling through the capacitance element C1D and the gate-channel capacitance of the transistor Q1, and it returns to the potential VDD-Vth at which it was before stepped up.

After that, the first driving circuit 130*a* repeats the above-described operations according to the transition of levels of the clock signals CLK and /CLK. That is to say, the dummy gate line driving signal GD1 is a repetitive pulse signal that is activated following the activation of the clock signal CLK and inactivated following the inactivation of the clock signal CLK.

As stated above, the transistors Q1D, Q3D and the capacitance element C1D of the first driving circuit 130*a* have the same dimensions as the transistors Q1, Q3 and the capacitance element C1 of the unit shift register SR of the gate line driving circuit 30, and the node N1D has the same parasitic capacitance as the node N1 of the unit shift register SR. Furthermore, the signal propagation delay time of the dummy gate line GDL1 is set equal to that of the normal gate lines GL. Accordingly, the timings of activation and inactivation of the dummy gate line driving signal GD1 agree with those of the gate line driving signal G outputted by a unit shift register SR driven by the clock signal CLK. That is to say, the dummy gate line driving signal GD1 is activated with the timing of activation of one of the gate line driving signals G in odd-numbered lines and inactivated at the same time as its inactivation.

On the other hand, the dummy gate line driving signal GD2 outputted from the second driving circuit 130*b* is a repetitive pulse signal that is activated following the activation of the clock signal /CLK and inactivated following the inactivation of the clock signal /CLK.

Also, the parasitic capacitance and signal propagation delay time of the second driving circuit 130*b* and the dummy gate line GDL2 are also set equal to those of the unit shift register SR of the gate line driving circuit 30 and the gate line driving signal G. Accordingly, the timings of activation and inactivation of the dummy gate line driving signal GD2 agree with those of the gate line driving signal G outputted from a unit shift register SR driven by the clock signal /CLK. That is to say, the dummy gate line driving signal GD2 is activated with the timing of activation of one of the gate line driving signals G in the even-numbered lines and inactivated at the same time as its inactivation.

The dummy gate line inactivation transition detecting circuit 140 activates the detect signal GOFF with the timings of inactivation of the dummy gate line driving signals GD1 and GD2 (falling timings). As a result, as shown in FIG. 6, the waveform of the detect signal GOFF is like that of the configuration of FIG. 2 (FIG. 3).

Third Modification

In the second modification, the dimensions of the transistors Q4D in the first and second driving circuits 130*a* and 130*b* (FIG. 10) are adjusted and the parasitic capacitance of the nodes N1D is set equivalent to the parasitic capacitance of the node N1 of the unit shift register SR (FIG. 8) of the gate line driving circuit 30 such that the dummy gate line driving signals GD1 and GD2 are synchronized with the gate line driving signals G. However, for the dummy gate line driving signals GD1 and GD2 of FIG. 10, the circuit configuration is different from that of the unit shift registers SR, and therefore it is not easy to set the dimensions of the transistors Q4D to make the parasitic capacitance of the nodes N1D correctly agree with that of the node N1. In this modification, a dummy gate line driving circuit 130 free from this problem will be described.

Figure 11:
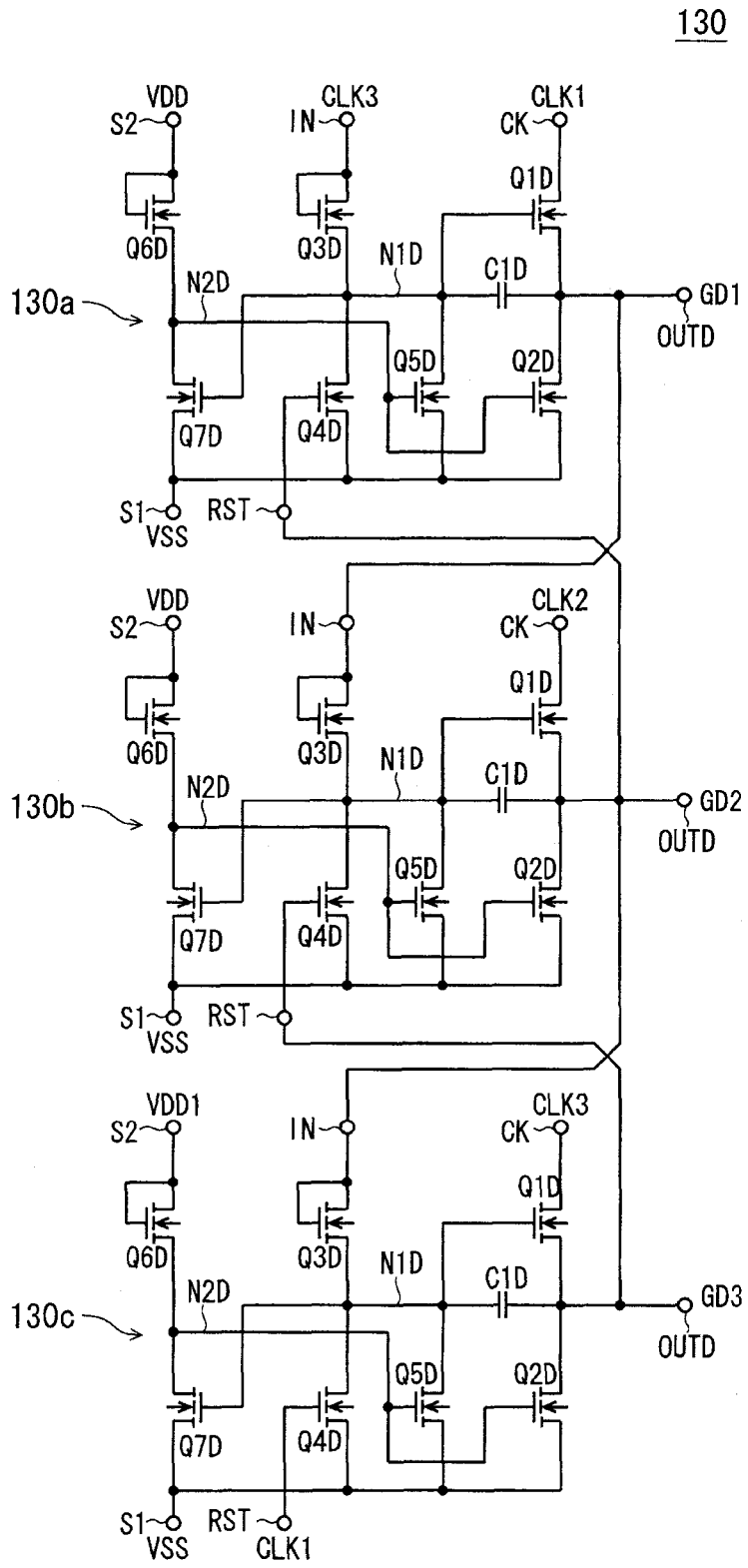
FIG. 11 is a circuit diagram of a dummy gate line driving circuit according to a third modification of the first preferred embodiment.

FIG. 11 is a diagram illustrating the configuration of the dummy gate line driving circuit 130 of the third modification of the first preferred embodiment. This dummy gate line driving circuit 130 is driven by using three-phase clock signals CLK1 to CLK3 whose phases are shifted by one horizontal scanning period (1H). Here, it is assumed that the clock signals CLK1 to CLK3 are activated in order of CLK1 CLK2, CLK3, CLK1, CLK2, . . . .

This dummy gate line driving circuit 130 includes a first driving circuit 130*a* for generating a dummy gate line driving signal GD1 activated following the clock signal CLK1, a second driving circuit 130*b* for generating a dummy gate line driving signal GD2 activated following the clock signal CLK2, and a third driving circuit 130*c* for generating a dummy gate line driving signal GD3 activated following the clock signal CLK3.

Though graphically not shown, the dummy gate line driving signal GD3 generated by the third driving circuit 130*c* is outputted to a dummy gate line GDL3 having the same signal propagation delay time as the normal gate line driving signals G. Also, the dummy gate line inactivation transition detecting circuit 140 includes a third detecting circuit 140*c* connected to the end of the dummy gate line GDL3 opposite to the end connected to the third driving circuit 130*c*, and the third detecting circuit 140*c* detects a fall of the dummy gate line driving signal GD3 and activates the detect signal GOFF with that timing. That is to say, the dummy gate line inactivation transition detecting circuit 140 of this modification operates to activate the detect signal GOFF with falling timings of the dummy gate line driving signals GD1, GD2 and GD3.

In this modification, it is preferred that the gate line driving circuit 30 is also driven by using the same clock signals CLK1 to CLK3 as the dummy gate line driving circuit 130. When the gate line driving circuit 30 is driven with two-phase clock signals CLK and /CLK, it is necessary to adjust phases and pulse widths such that the active periods of the clock signals CLK1 to CLK3 for driving the dummy gate line driving circuit 130 agree with the active periods of the clock signals CLK and /CLK. Also, driving the gate line driving circuit 30 and the dummy gate line driving circuit 130 with different clock signals is not preferred also because it complicates the configuration and increase costs.

As shown in FIG. 11, the first to third driving circuits 130*a*, 130*b* and 130*c* have the same configuration as the unit shift registers SR (FIG. 8) of the gate line driving circuit 30 (in FIG. 11, elements corresponding to those of FIG. 8 are shown by the same reference characters with letter "D"), and they are cascade-connected to form a three-stage shift register. In the first to third driving circuits 130*a*, 130*b* and 130*c*, the transistors Q1D to Q7D and the capacitance element CD1 have the same dimensions as the transistors Q1 to Q7 and the capacitance element C1 of the unit shift register SR. As a result, the parasitic capacitance of the nodes N1D of the first to third driving circuits 130*a*, 130*b* and 130*c* is equal to that of the node N1 of the unit shift register SR.

One of the clock signals CLK1 to CLK3 is inputted as a start pulse of the three-stage shift register to the input terminal IN of the first driving circuit 130*a* in the first stage, and clock signals to be supplied to the clock terminals CK of the individual stages are determined according to this. When the clock signal CLK3 is inputted to the input terminal IN of the first driving circuit 130*a* as shown in FIG. 11, the clock signal CLK1 activated next is inputted to the input terminal IN of the first driving circuit 130*a*, and the clock signal. CLK2 activated next to the clock signal CLK1 is inputted to the clock terminal CK of the second driving circuit 130*b* in the second stage, and the clock signal CLK3 activated next to the clock signal CLK2 is inputted to the clock terminal CK of the third driving circuit 130*c* in the third stage.

The operation of the dummy gate line driving circuit 130 of FIG. 11 will be described. First, the first driving circuit 130*a* goes into a set state when the clock signal CLK3 goes to H level, and after that the dummy gate line driving signal GD1 is at H level while the clock signal CLK1 is at H level. In response, the second driving circuit 130*b* goes into a set state, and after that the dummy gate line driving signal GD2 is at H level while the clock signal CLK2 is at H level. In response, the third driving circuit 130*c* goes into a set state, and after that the dummy gate line driving signal GD3 is at H level while the clock signal CLK3 is at H level. Also, when the clock signal CLK3 goes to H level, the first driving circuit 130*a* goes into a set state again, and these operations are repeated after that.

Figure 12:
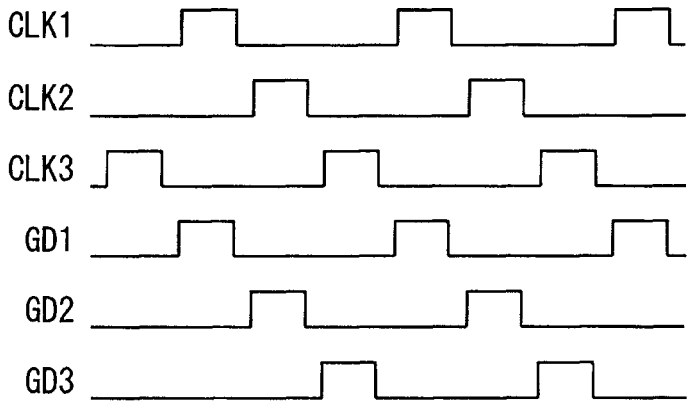
FIG. 12 is a signal waveform diagram illustrating the operation of the dummy gate line driving circuit according to the third modification of the first preferred embodiment.

Accordingly, as shown in FIG. 12, the dummy gate line driving signals GD1, GD2 and GD3 are repetitive pulse signals that are activated following the activation of the clock signals CLK1, CLK2, CLK3.

As described above, the parasitic capacitance of the first to third driving circuits 130*a*, 130*b* and 130*c* is set equal to that of the unit shift registers SR of the gate line driving circuit 30, and the signal propagation delay time of the dummy gate lines GDL1 to GDL3 is set equal to that of the normal gate line driving signals G. Accordingly, the timings of activation and inactivation of the dummy gate line driving signals GD1, GD2 and GD3 agree with those of the gate line driving signals G outputted by the unit shift registers SR driven by the clock signals CLK1 to CLK3.

Also, the dummy gate line inactivation transition detecting circuit 140 activates the detect signal GOFF with timings of inactivation (falling timings) of the dummy gate line driving signals GD1, GD2 and GD3. As a result, the waveform of the detect signal GOFF is like that of the configuration of FIG. 2 (FIG. 3).

Accordingly, like the liquid-crystal display apparatus 200 of FIG. 2, this modification also prevents display errors due to the delay of the gate line driving signal $G_k$. Also, the increase of the circuit area is suppressed because it uses the dummy gate line inactivation transition detecting circuit 140 connected only to the three dummy gate line driving signals GD1 to GD3 in place of the gate line inactivation transition detecting circuit 90 connected to all gate lines GL.

Furthermore, circuits having the same configuration as the unit shift registers SR of the gate line driving circuit 30 are used as the first to third driving circuits 130*a*, 130*b* and 130*c* of the dummy gate line driving circuit 130, so that it is easy to make their parasitic capacitances equivalent. Accordingly, it is possible to make the dummy gate line driving signals GD1 to GD3 more correctly synchronized with the gate line driving signals G.

Fourth Modification

Figure 13:
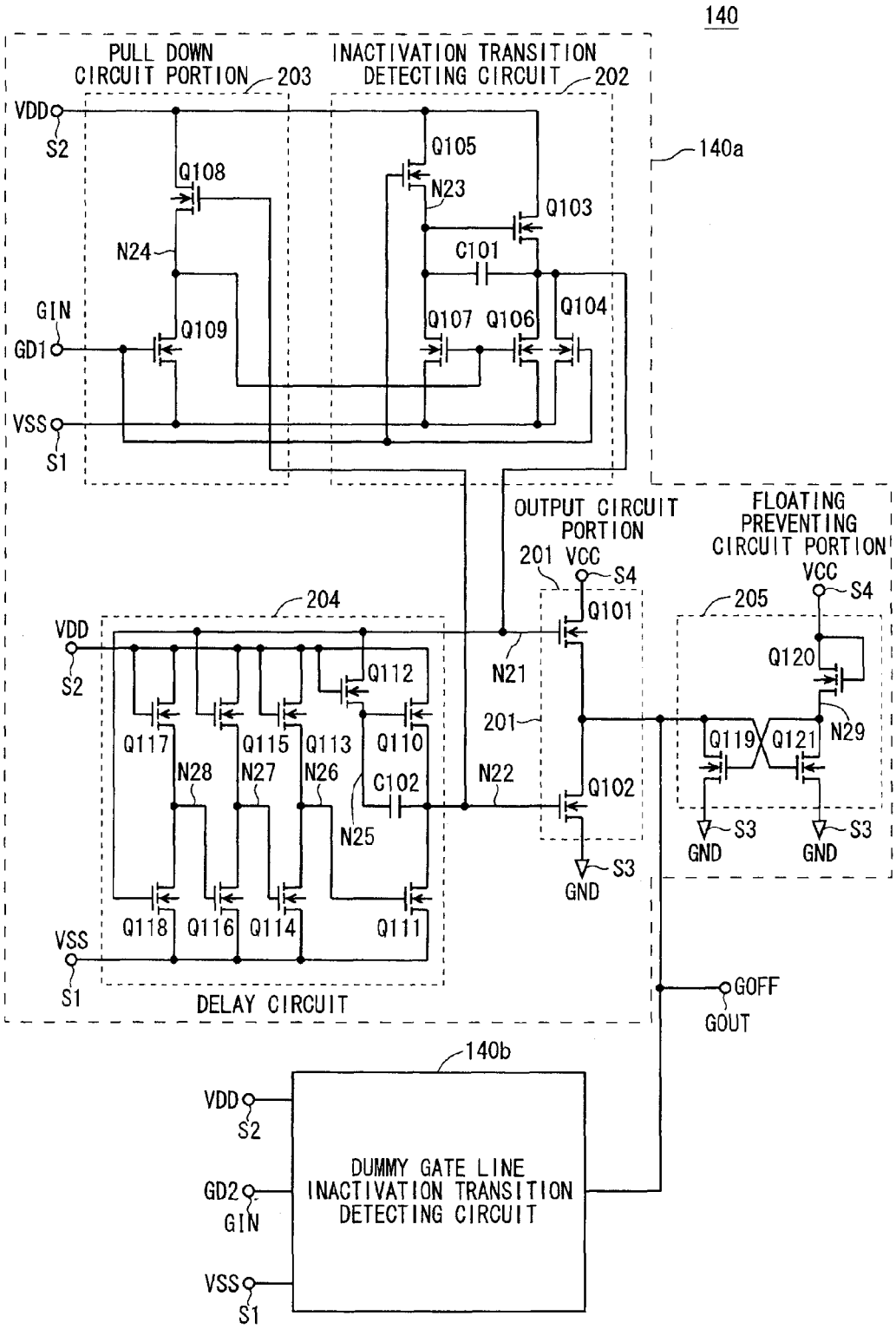
FIG. 13 is a configuration diagram of a dummy gate line inactivation transition detecting circuit according to a fourth modification of the first preferred embodiment.

In this modification, a specific example of the configuration of the dummy gate line inactivation transition detecting circuit 140 will be described. FIG. 13 is a configuration diagram of the dummy gate line inactivation transition detecting circuit 140 according to a fourth modification of the first preferred embodiment. Like that of FIG. 10, this example shows a configuration in which the dummy gate line inactivation transition detecting circuit 140 includes a first detecting circuit 140*a* for detecting a fall of the dummy gate line driving signal GD1 and a second detecting circuit 140*b* for detecting a fall of the dummy gate line driving signal GD2. FIG. 13 only shows the circuit of the first detecting circuit 140*a*, but the second detecting circuit 140*b* has the same circuit configuration. Also, the output nodes of the first detecting circuit 140*a* and the second detecting circuit 140*b* (the connection nodes between the transistors Q101 and Q102) are both connected to the output terminal GOUT for outputting the detect signal GOFF.

The dummy gate line inactivation transition detecting circuit 140 includes an output circuit portion 201, an inactivation transition detecting circuit portion 202, a pull down circuit portion 203, a delay circuit portion 204, and a floating preventing circuit portion 205. The floating preventing circuit portion 205 is a portion that prevents floating state of the output terminal OUT to which the first and second detecting circuits 140*a* and 140*b* are connected in common, and so it is shared between the first and second detecting circuits 140*a* and 140*b*.

The output circuit portion 201 and the floating preventing circuit portion 205 are supplied with power supplies common to the source driver 40 to which the detect signal GOFF is outputted (the high-side power-supply potential is taken as VCC, and the low-side power-supply potential is taken as GND). The other, inactivation transition detecting circuit portion 202, pull down circuit portion 203, and delay circuit portion 204 are supplied with power supplies common to the gate line driving circuit 30 (the high-side power-supply potential VDD, low-side power-supply potential VSS).

The output circuit portion 201 includes a transistor Q102 connected between the output terminal GOUT and a third power-supply terminal S3 supplied with the potential GND, and a transistor Q101 connected between the output terminal GOUT and a fourth power-supply terminal S4 supplied with the potential VCC. The node to which the gate of the transistor Q101 connects is defined as "node N21", and the node to which the gate of the transistor Q102 connects is defined as "node N22". The transistor Q101 functions to charge the output terminal GOUT to bring the detect signal GOFF to H level in response to activation of the signal (first signal) at the node N21. The transistor Q102 functions to discharge the output terminal GOUT to bring the detect signal GOFF to L level in response to activation of the signal (second signal) at the node N22.

The inactivation transition detecting circuit portion 202 detects the dummy gate line driving signal GD1 going to L level, and charges the node N21 in response to it, and it is formed of transistors Q103 to Q107 and a capacitance element C101 described below.

The transistor Q103 is connected between the node N21 and a second power-supply terminal S2 supplied with the potential VDD. The transistor Q104 is connected between the node N21 and a first power-supply terminal S1 supplied with the potential VSS, and its gate is connected to the input terminal GIN. The dummy gate line driving signal GD1 is inputted to the input terminal GIN of the first detecting circuit 140*a* (i.e. the input terminal GIN is connected to the dummy gate line GDL1). The on-state resistance of the transistor Q104 is set sufficiently smaller than that of the transistor Q103, and the transistors Q103 and Q104 form a ratio-type inverter.

When the node to which the gate of the transistor Q103 connects is defined as "node N23", the transistor Q105 is connected between the second power-supply terminal S2 and the node N23, and its gate is connected to the input terminal GIN. The capacitance element Q101 is connected between the node N21 and the node N23. The transistor Q106 is connected between the node N21 and the first power-supply terminal S1, and the transistor Q107 is connected between the node N23 and the first power-supply terminal S1. The gates of the transistors Q106 and Q107 are connected to each other, and the node to which the gates connect is defined as "node N24".

After the inactivation transition detecting circuit portion 202 brought the node N21 to H level and then a given period has passed (the length of this period is defined by the delay circuit portion 204), the pull down circuit portion 203 causes the inactivation transition detecting circuit portion 202 to discharge the node N21 to bring the node N21 to L level. The pull down circuit portion 203 includes a transistor Q108 having a gate connected to the node N22 and connected between the second power-supply terminal S2 and the node N24, and a transistor Q109 having a gate connected to the input terminal GIN and connected between the node N24 and the first power-supply terminal S1.

The delay circuit portion 204 outputs, to the node N22, a signal (second signal) by delaying the signal at the node N21 (first signal) by a given period, and the length of the given period determines the pulse width of the detect signal GOFF. The delay circuit portion 204 is formed of transistors Q110 to Q118 and a capacitance element C102 described below.

The transistor Q110 is connected between the second power-supply terminal S2 and the node N22, and the transistor Q111 is connected between the node N22 and the first power-supply terminal S1. The node to which the gate of the transistor Q110 connects is defined as "node N25" and the node to which the gate of the transistor Q111 connects is defined as "node N26". The transistor Q112 is connected between the node N21 and the node N25, and its gate is connected to the second power-supply terminal S2. The capacitance element C102 is connected between the node N22 and the node N25. The capacitance element C102 functions to step up the gate of the transistor Q110 (node N25) when the transistor Q110 charges the node N22. The transistors Q110. Q111 and Q112 and the capacitance element C102 form a bootstrap inverter.

The transistor Q113 is connected between the second power-supply terminal S2 and the node N26, and its gate is connected to the second power-supply terminal S2. The transistor Q114 is connected between the node N26 and the first power-supply terminal S1. The node to which the gate of the transistor Q114 connects is defined as "node N27". The on-state resistance of the transistor Q114 is set sufficiently smaller than that of the transistor Q113, and the transistors Q113 and Q114 form a ratio-type inverter having the node N27 as an input end and the node N26 as an output end.

The transistor Q115 is connected between the second power-supply terminal S2 and the node N27, and its gate is connected to the node N21. The transistor Q116 is connected between the node N27 and the first power-supply terminal S1. The node to which the gate of the transistor Q116 connects is defined as "node N28". The transistors Q115 and Q116 form a push-pull-type inverter having the node N28 as an input end and the node N27 as an output end.

The transistor Q117 is connected between the second power-supply terminal S2 and the node N28, and its gate is connected to the second power-supply terminal S2. The transistor Q118 is connected between the node N28 and the first power-supply terminal S1, and its gate is connected to the node N21. The on-state resistance of the transistor Q118 is set sufficiently smaller than that of the transistor Q117, and the transistors Q117 and Q118 form a ratio-type inverter having the node N21 as an input end and the node N28 as an output end.

When the detect signal GOFF is set at L level, the floating preventing circuit portion 205 sets the output terminal GOUT at L level (GND) with low impedance to prevent floating state of the detect signal GOFF. The floating preventing circuit portion 205 is formed of transistors Q119 to Q121 below.

The transistor Q119 is connected between the output terminal GOUT and the third power-supply terminal S3. When the node to which the gate of the transistor Q119 connects is defined as "node N29", the transistor Q120 is connected between the fourth power-supply terminal S4 and the node N29, and its gate is connected to the fourth power-supply terminal S4. The transistor Q121 is connected between the node N29 and the third power-supply terminal S3, and its gate is connected to the output terminal GOUT. The on-state resistance of the transistor Q121 is set sufficiently smaller than that of the transistor Q120, and the transistors Q120 and Q121 form a ratio-type inverter having the output terminal GOUT as an input end and the node N29 as an output end.

Figure 14:
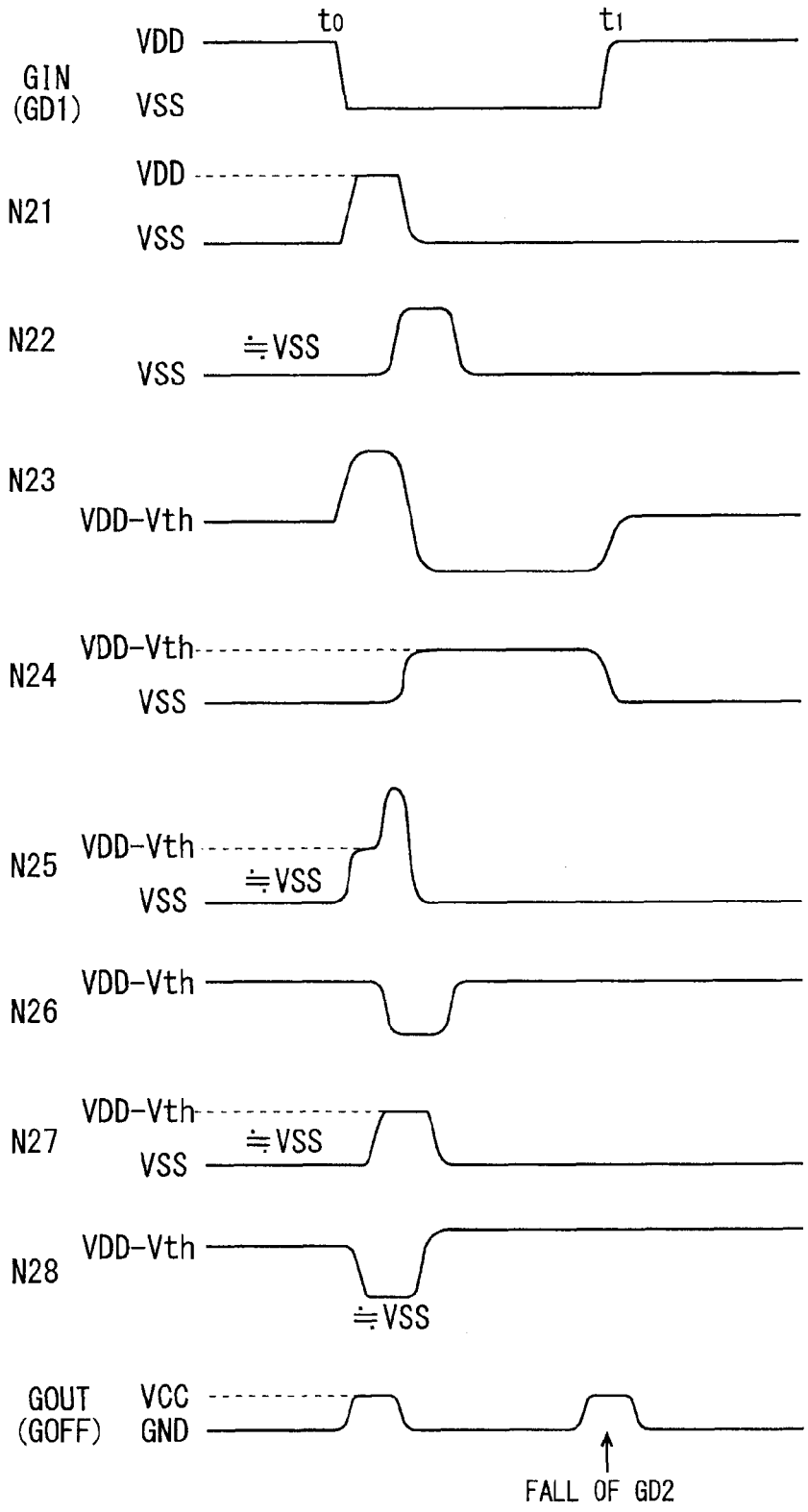
FIG. 14 is a signal waveform diagram am illustrating the operation of the dummy gate line inactivation transition detecting circuit according to the fourth modification of the first preferred embodiment.

FIG. 14 is a signal waveform diagram illustrating the operation of the dummy gate line inactivation transition detecting circuit 140 of FIG. 13. Now, referring to FIG. 14, the operation of the dummy gate line inactivation transition detecting circuit 140 will be described.

First, the state of the dummy gate line inactivation transition detecting circuit 140 before time t0 will be described. Before time to, the dummy gate line driving signal GD1 is at H level, and the transistor Q109 of the pull down circuit portion 203 is on. Also, as will be described later, the node N22 at this time is at L level, and the transistor Q108 is off. Accordingly, the node N24 is at L level (VSS).

Accordingly, the transistors Q107 and Q106 in the inactivation transition detecting circuit portion 202 are off. Also, the transistor Q105 is on, and so the node N23 is at H level (VDD-Vth), and so the transistor Q103 is on. However, since the transistor Q104 having smaller on-state resistance is also on, the node N21 is at L level of a potential (approximately equal to VSS) determined by the on-state resistance ratio of the transistors Q103 and Q104.

The node N21 is at L level, and so the transistor Q118 in the delay circuit portion 204 is off, and the node N28 is at H level (VDD-Vth). Accordingly, the transistor Q116 is on, and the transistor Q115 is off, and so the node N27 is at L level (VSS). Accordingly, the transistor Q114 is off, and the node N26 is at H level (VDD-Vth). Accordingly, the transistor Q111 is on. Also, the node N25 is discharged by the transistor Q112 and at L level (approximately equal to VSS). Accordingly, the transistor Q110 is off. Accordingly, the node N22 is at L level (VSS).

In this way, before time t0, the nodes N21 and N22 are both at L level, and the transistors Q101 and Q102 in the output circuit portion 201 are off. But, as will be described later, the detect signal GOFF at this time is set at L level. Accordingly, the transistor Q121 in the floating preventing circuit portion 205 is off, and the node N29 is at H level, and the transistor Q119 is on and fixes the output terminal GOUT (detect signal GOFF) at L level with low impedance.

Then, at time t0, the dummy gate line driving signal GD1 goes to L level, and the transistor Q109 in the pull down circuit portion 203 turns off, but the transistor Q108 is off at this time and the node N24 does not change from L level. Accordingly, the transistors Q106 and Q107 in the inactivation transition detecting circuit portion 202 keep off.

In the inactivation transition detecting circuit portion 202, the transistors Q104 and Q105 turn off. At this time, the transistor Q107 is kept off, and the node N23 stays at H level, and the transistor Q103 keeps on. Accordingly, the node N21 is charged by the transistor Q103 and goes to H level. In response to the level rise of the node N21 at this time, the capacitance element C101 steps up the node N23. As a result, the transistor Q103 operates in non-saturation region, and the node N21 is charged at high speed, and its H level potential rises to VDD.

When the node N21 goes to H level, the transistor Q101 in the output circuit portion 201 turns on and the output terminal GOUT is charged. At this time, the transistor Q119 in the floating preventing circuit 205 is on, but the level of the output terminal GOUT rises since the on-state resistance value of the transistor Q101 is set sufficiently lower than the on-state resistance value of the transistor Q119. In response, the transistor Q121 turns on. Since the transistors Q120 and Q121 form a ratio-type inverter, the node N29 goes to L level and the transistor Q119 turns off.

As a result, the level rise of the output terminal GOUT is accelerated, and the detect signal GOFF goes to H level. Since usually the H level potential of the node N21 (VDD) is sufficiently higher than the potential VCC of the drain of the transistor Q101 (the fourth power-supply terminal S4), the transistor Q101 operates in non-saturation region and the H level potential of the detect signal GOFF becomes VCC.

Figure 15:
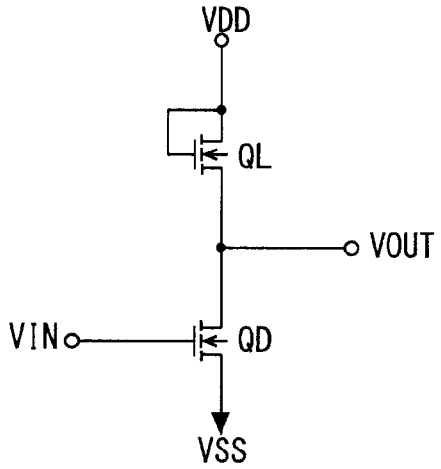
FIG. 15 is a circuit diagram of a ratio-type inverter.

Now, the timing of the level rise of the node N21 depends on the on-state resistance ratio of the transistors Q103 and Q104. This will be described referring to FIGS. 15 and 16. FIG. 15 shows a ratio-type inverter formed of a diode-connected load transistor QL and a drive transistor QD, and FIG. 16 shows the input/output transfer characteristics of that inverter.

Figure 16:
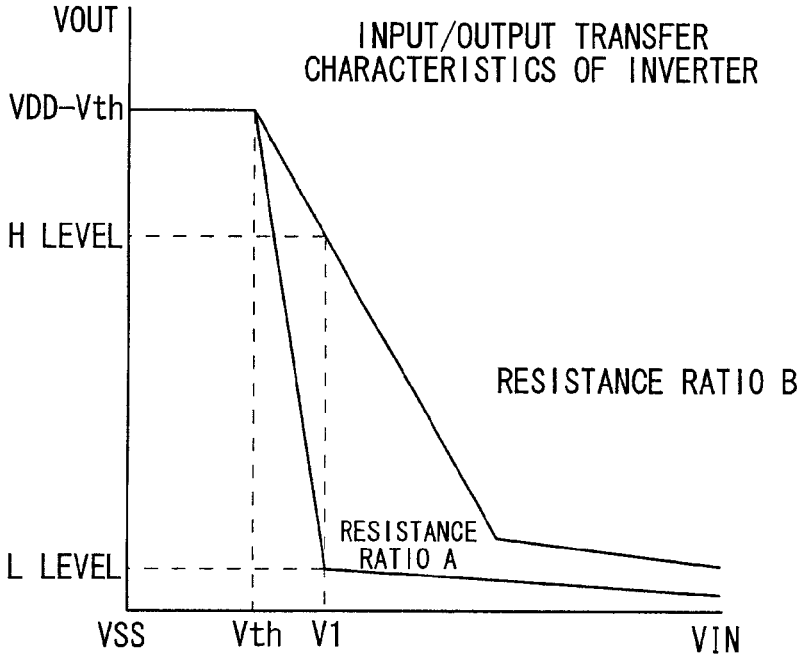
FIG. 16 is a diagram illustrating input/output transfer characteristics of the ratio-type inverter.

FIG. 16 shows two transfer characteristics (resistance ratio A, resistance ratio B). The resistance ratio is defined as "the on-state resistance value of the drive transistor QD/the on-state resistance value of the load transistor QL", and there is a relation "resistance ratio A<resistance ratio B". That is to say, it means that, when the on-state resistance value of the load transistor QL is the same, the on-state resistance value of the drive transistor QD is lower in the case of the resistance ratio A than in the case of the resistance ratio B. As can be seen from FIG. 16, the inversion of the inverter output voltage occurs at smaller input voltage VIN as the resistance ratio is lower (as the on-stare resistance value of the drive transistor QD is smaller).

In the same way, in the ratio circuit formed of the transistors Q103 and Q104 of FIG. 13, as the resistance ratio defined as "the on-state resistance value of the transistor Q104/the on-state resistance value of the transistor Q103" is smaller (as the on-state resistance value of the transistor Q104 is smaller), the timing with which the level of the node N21 starts rising is when the level of the dummy gate line driving signal GD1 falls lower. On the other hand, as the resistance ratio is larger, the timing with which the level of the node N21 starts rising is in a relatively earlier stage while the level of the dummy gate line driving signal GD1 falls.

In this way, the timing of level rise of the node N21, i.e. the rising timing of the detect signal GOFF, can be adjusted by adjusting the resistance ratio of the transistors Q103 and Q104 of the inactivation transition detecting circuit portion 202.

Erroneous writing of the display signal of the next line is less likely to happen as the rising timing of the detect signal GOFF is when the dummy gate line driving signal GD1 becomes a lower level (a level close to VSS). However, for this purpose, the gate width of the transistor Q104 must be enlarged such that the on-state resistance of the transistor Q104 is smaller, and then the circuit area is enlarged. Also, enlarging the gate width of the transistor Q104 also enlarges the parasitic capacitance of the drain, and it should also be noted that the rising speed of the node N21 becomes slower.

Referring to FIGS. 13 and 14 again, when the node N21 goes to H level at time t0, the transistor Q118 turns on in the transistor delay circuit portion 204. Since the transistors Q117 and Q118 form a ratio-type inverter, the node N28 is discharged to L level (approximately equal to VSS). In response, the transistor Q116 turns off, and the transistor Q115 is on when the node N21 is at H level, and the node N27 is charged to H level (VDD-Vth). Then, the transistor Q114 turns on. The transistors Q113 and Q114 form a ratio-type inverter, and so the node N26 is discharged to L level (approximately equal to VSS).

When the node N21 attains H level, the gate of the transistor Q110 (the node N25) is already charged by the transistor Q112 to H level (VDD-Vth), and the transistor Q110 is on. Accordingly, the node N26 goes to L level and the transistor Q111 turns off, and then the level of the node N22 rises. At this time, due to the coupling through the capacitance element C102, the node N25 is stepped up. As a result, the transistor Q110 operates in non-saturation region, and the node N22 is charged at high speed and becomes H level of potential VDD. In this way, in the delay circuit portion 204, a delay of time required for the inversion of four stages of inverters occurs between the timing of level rise of the node N21 and the timing of level rise of the node N22.

When the node N22 goes to H level, the transistor Q102 in the output circuit portion 201 turns on. Also, the transistor Q108 in the pull down circuit portion 203 turns on, and the node N24 goes to H level, and so the transistors Q107 and Q106 in the inactivation transition detecting circuit portion 202 turn on. Accordingly, the node N23 goes to L level, and the transistor Q103 turns off and the node N21 goes to L level (VSS). Accordingly, the transistor Q101 in the output circuit portion 201 turns off. As a result, the detect signal GOFF is discharged by the transistor Q102 and goes to L level.

The delay circuit portion 204 delays the signal at the node N21 by a certain period and outputs it to the node N22, and therefore, when the node N21 goes to L level, the node N22 also goes to L level after the certain period, and the transistor Q102 turns off. However, when the detect signal. GOFF goes to L level, the transistor Q121 in the floating preventing circuit 205 turns off and the node N29 goes to H level. In response, the transistor Q119 turns on, and the output terminal GOUT is maintained at L level (GND) with low impedance even after the transistor Q102 turns off.

As described above, the first detecting circuit 140*a* operates to bring the detect signal to H level (VCC) with a falling timing of the dummy gate line driving signal GD1, and returns it to L level (GND) after a certain time (the delay time by the delay circuit portion 204) has passed.

On the other hand, in the second detecting circuit 140*b*, the dummy gate line driving signal GD2 is supplied to the input terminal GIN and the same operations as above are performed. That is to say, the second detecting circuit 140*b* brings the detect signal GOFF to H level (VCC) with a falling timing of the dummy gate line driving signal GD2, and returns it to L level (GND) after a certain time has passed.

Accordingly, the detect signal GOFF outputted from the common output terminal GOUT is a positive pulse signal that is at H level for certain periods at falls of the dummy gate line driving signals GD1 and GD2.

When the parasitic capacitance of the output terminal GOUT is large and the parasitic capacitance serves as stabilization capacitance for the detect signal GOFF, the parasitic capacitance can hold the L level of the detect signal GOFF even when the output terminal GOUT goes in a floating state, in which case the floating preventing circuit portion 205 can be omitted.

Fifth Modification

The fourth modification has shown the configuration of the dummy gate line inactivation transition detecting circuit 140 that is provided only for the dummy gate lines GDL1 and GDL2 as shown in FIGS. 5 and 10. This modification shows the configuration of the gate line inactivation transition detecting circuit 90 provided for each of the normal gate lines GL as shown in FIG. 4.

When a circuit for detecting a fall of a gate line driving signal G is provided for each gate line GL, such a detecting circuit can logically be the same as the detecting circuit (the first detecting circuit 140*a*) shown in FIG. 13. However, in the detecting circuit of FIG. 13, as can be seen from the operation shown in FIG. 14, while the signal inputted to the input terminal GIN (which corresponds to the dummy gate line driving signal GD1) goes to L level and then return to H level, the transistors Q108 and Q109 are both off and the node N24 maintains H level in floating state. Accordingly, when that period is long, the H level of the node N24 cannot be maintained.

This problem does not occur in the case of the dummy gate line inactivation transition detecting circuit 140 because a dummy gate line driving signal that is activated in the cycle of 2 horizontal scanning periods (2H) is inputted to each detecting circuit. However, in the case of the gate line inactivation transition detecting circuit 90 provided for the normal gate lines GL, a gate line driving signal G activated in the cycle of about one frame period is inputted to each detecting circuit, and therefore the problem described above occurs. This modification shows fall detecting circuits solving this problem.

Figure 17:
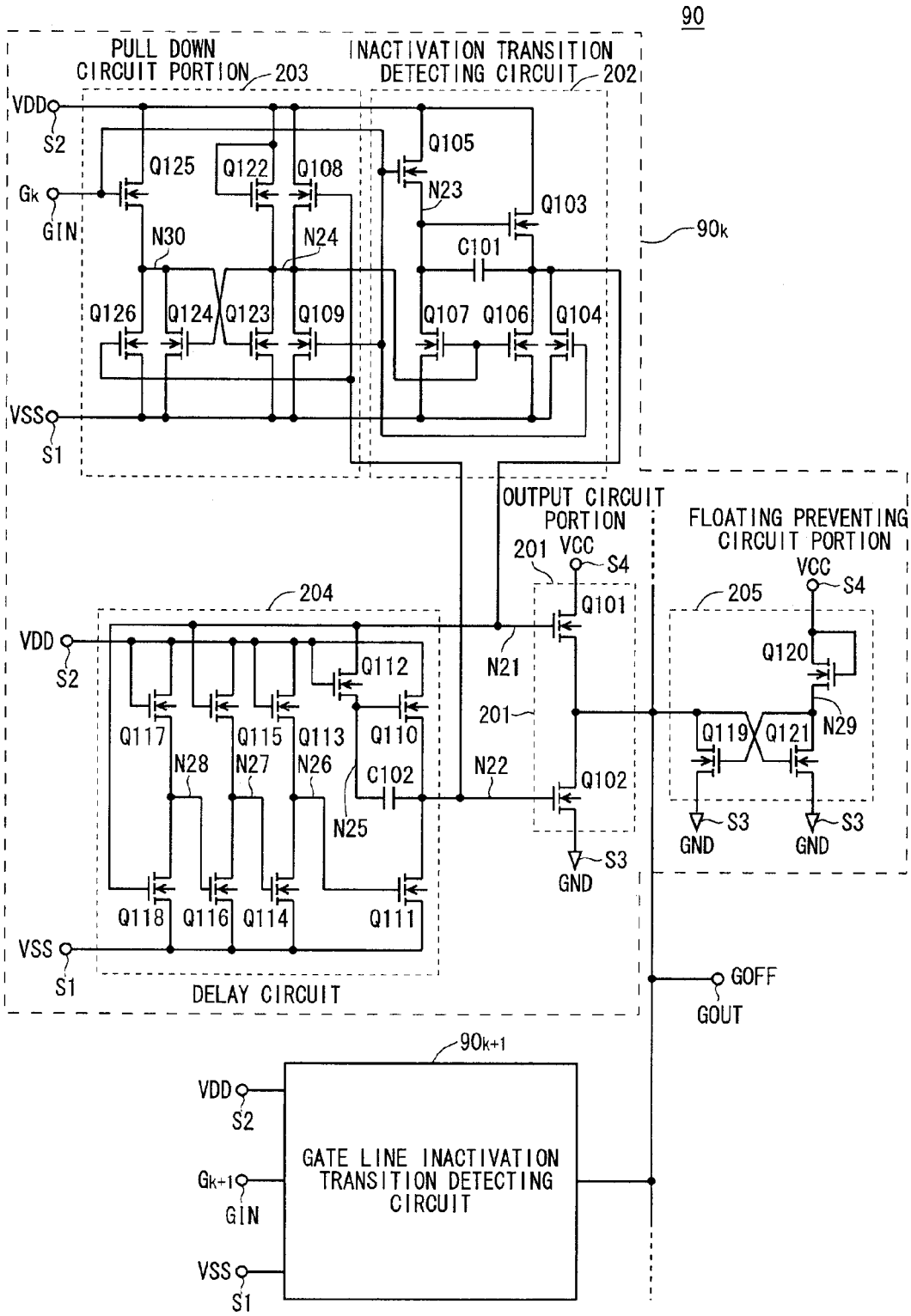
FIG. 17 is a diagram illustrating the configuration of a gate line inactivation transition detecting circuit according to a fifth modification of the first preferred embodiment.

FIG. 17 is a diagram illustrating the configuration of a gate line inactivation transition detecting circuit 90 according to a fifth modification of the first preferred embodiment. The gate line inactivation transition detecting circuit 90 includes a plurality of detecting circuits connected to respective gate lines GL to detect falls of the gate line driving signals G. As an example, FIG. 17 shows a detecting circuit $\mathbf{90}_k$ connected to the kth gate line $GL_k$ to detect a fall of the gate line driving signal $G_k$. Detecting circuits provided for other gate lines GL can be the same circuit configuration.

Like the detecting circuit shown in FIG. 13 (the first detecting circuit 140*a*), the detecting circuit $\mathbf{90}_k$ includes an output circuit portion 201, an inactivation transition detecting circuit portion 202, a pull down circuit portion 203, a delay circuit portion 204, and a floating preventing circuit portion 205. All detecting circuits connected to the gate lines GL are connected to the output terminal GOUT for outputting the detect signal GOFF, and the floating preventing circuit portion 205 is shared by all of the detecting circuits.

As compared with the detecting circuit of FIG. 13, the detecting circuit $\mathbf{90}_k$ of FIG. 17 includes a flip-flop circuit formed of transistors Q122 to Q126 for holding the level of the node N24 in the pull down circuit portion 203.

In the flip-flop circuit, the transistor Q122 is connected between the second power-supply terminal S2 and the node N24, and its gate is connected to the second power-supply terminal S2 (the transistor Q122 is diode-connected). The transistor Q123 is connected between the node N24 and the first power-supply terminal S1. The node to which the gate of the transistor Q123 connects is defined as "node N30". The on-state resistance of the transistor Q123 is set sufficiently smaller than that of the transistor Q122, and the transistors Q122 and Q123 form a ratio-type inverter. Also, the on-state resistance of the transistor Q122 is set sufficiently higher than that of the transistor Q109 such that the transistor Q109 can bring the node N24 to L level.

The transistor Q124 is connected between the node N30 and the first power-supply terminal S1, and its gate is connected to the node N24. The transistor Q125 is connected between the second power-supply terminal S2 and the node N30, and its gate is connected to the input terminal GIN. The transistor Q126 is connected between the node N30 and the first power-supply terminal S1 and its gate is connected to the node N22.

The detecting circuit $\mathbf{90}_k$ of FIG. 17 operates basically the same as the detecting circuit shown in FIG. 13 (FIG. 14), and so the operation of the flip-flop circuit will be described referring to FIG. 14. As shown in the diagram, when the gate line driving signal $G_k$ inputted to the input terminal GIN is at H level, the node N22 is at L level. Accordingly, the transistor Q108 is off and the transistor Q109 is on, and the node N24 is set at L level. At this time, in the flip-flop circuit, the transistor Q125 is on and the transistors Q124 and Q126 are off, and the node N30 is at H level, and the transistor Q123 is on.

After that, when the gate line driving signal $G_k$ changes to L level, the transistor Q109 turns off. At this time, the transistor Q125 of the flip-flop circuit also turns off, but the node N30 is kept at H level in a floating state, and the transistor Q123 keeps on, and so the node N24 is kept at L level.

At this time, the inactivation transition detecting circuit portion 202 brings the node N21 to H level, and the detect signal GOFF goes to H level. Then, after a certain period, the delay circuit portion 204 brings the node N22 to H level, and the detect signal GOFF returns to L level.

When the node N22 goes to H level, the transistor Q108 turns on, and the node N24 is set at H level. At this time, in the flip-flop circuit, the transistor Q125 is off and the transistors Q124 and Q126 are on, and the node N30 is at L level, and the transistor Q123 is off. As a result, the node N24 is maintained at H level in a direct current manner by the charge supplied through the diode-connected transistor Q122. Accordingly, the node N24 is surely maintained at H level for the length of about one frame period until the gate line driving signal $G_k$ is activated next.

Sixth Modification

In the fall detecting circuits shown in FIGS. 13 and 17, the delay circuit portion 204 is formed of four stages of cascade-connected inverters, but the number of stages is not limited to four stages. The length of the delay time generated by the delay circuit portion 204 can be adjusted by increasing/decreasing the number of inverter stages in the delay circuit portion 204, so as to adjust the pulse width of the detect signal GOFF.

In FIGS. 13 and 17, diode-connected transistors are used as the load elements of the ratio-type inverters included in the delay circuit portion 204, but, instead, resistance elements, constant current source elements (depletion mode transistors), transistors supplied with repeating signals at the gate, or bootstrap-type load circuits may be used, for example. This applies also to the transistor Q122 as a load element of the flip-flop circuit of the pull down circuit portion 203 of FIG. 17.

Also, in the bootstrap-type load circuit (the transistors Q110 and Q112 and the capacitance element C102) of the final-stage inverter of the delay circuit 204, power consumption is reduced by controlling the gate voltage of the transistor Q110 (the node N25). That is to say, in this inverter, when the transistor Q111 turns on, the transistor Q112 discharges the node N25 and turns off the transistor Q110, so as to prevent the flow of through current in the transistors Q110 and Q111. In place of the load circuit, a common bootstrap-type load circuit (where the gate voltage of the transistor Q110 is not controlled), resistance element, constant current source element (depletion transistor), diode-connected transistor, or transistor supplied with repeating signal at the gate may be used, for example.

The description above assumes that the liquid-crystal array portion 20, gate line driving circuit 30 and the level shifter 120 of a liquid-crystal display apparatus are integrated together, but the level shifter 120 may be applied to a display apparatus using a semiconductor integrated circuit formed of single crystal silicon. In this case, a display apparatus capable of higher-speed operation is realized.

Second Preferred Embodiment

Figure 18:
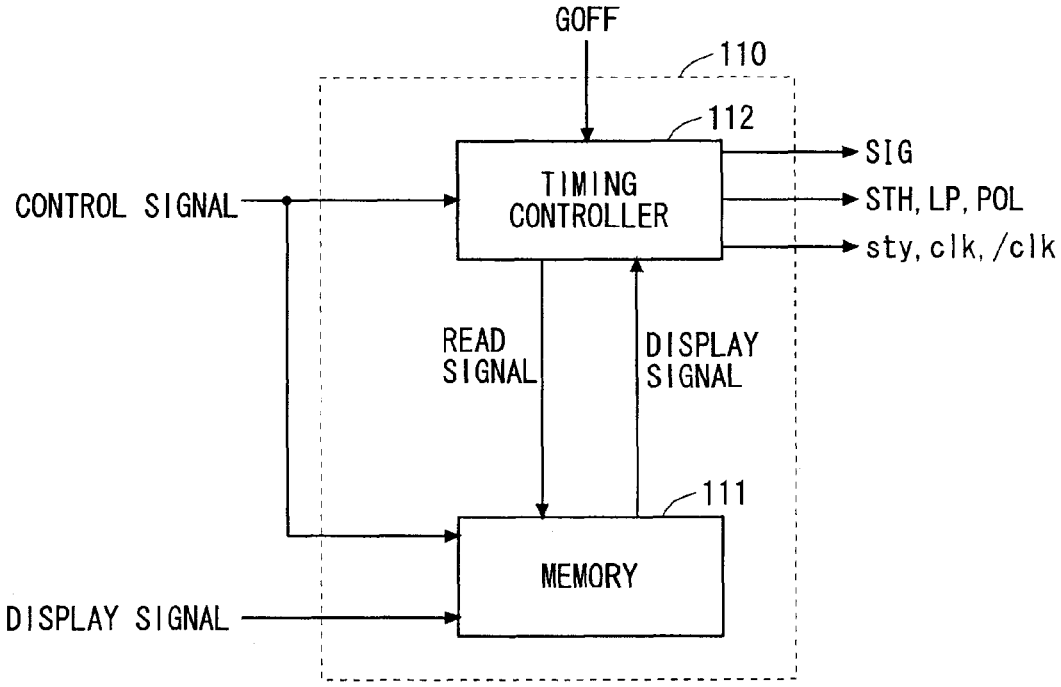
FIG. 18 is a schematic block diagram of a controller according to a second preferred embodiment.

A second preferred embodiment will describe the controller 110 provided in the display apparatus of the present invention. FIG. 18 is a block diagram illustrating the configuration of the controller 110. As shown in this diagram, the controller 110 includes a memory 111 and a timing controller 112, and control signals and a display signal outputted from the system 100, and the detect signal GOFF outputted from the gate line inactivation transition detecting circuit 90 (or the dummy gate line inactivation transition detecting circuit 140) are inputted thereto.

The memory 111 is capable of holding data (display data) for one pixel line of the display signal from the system 100, and it operates such that data is read in the order in which it was written. This operation will be described referring to FIG. 20. It is assumed here that the number of display data pieces for one pixel line is 10 pieces. In this case, the memory 111 has 10 cells C1 to C10 for storing display data.

Figure 20:
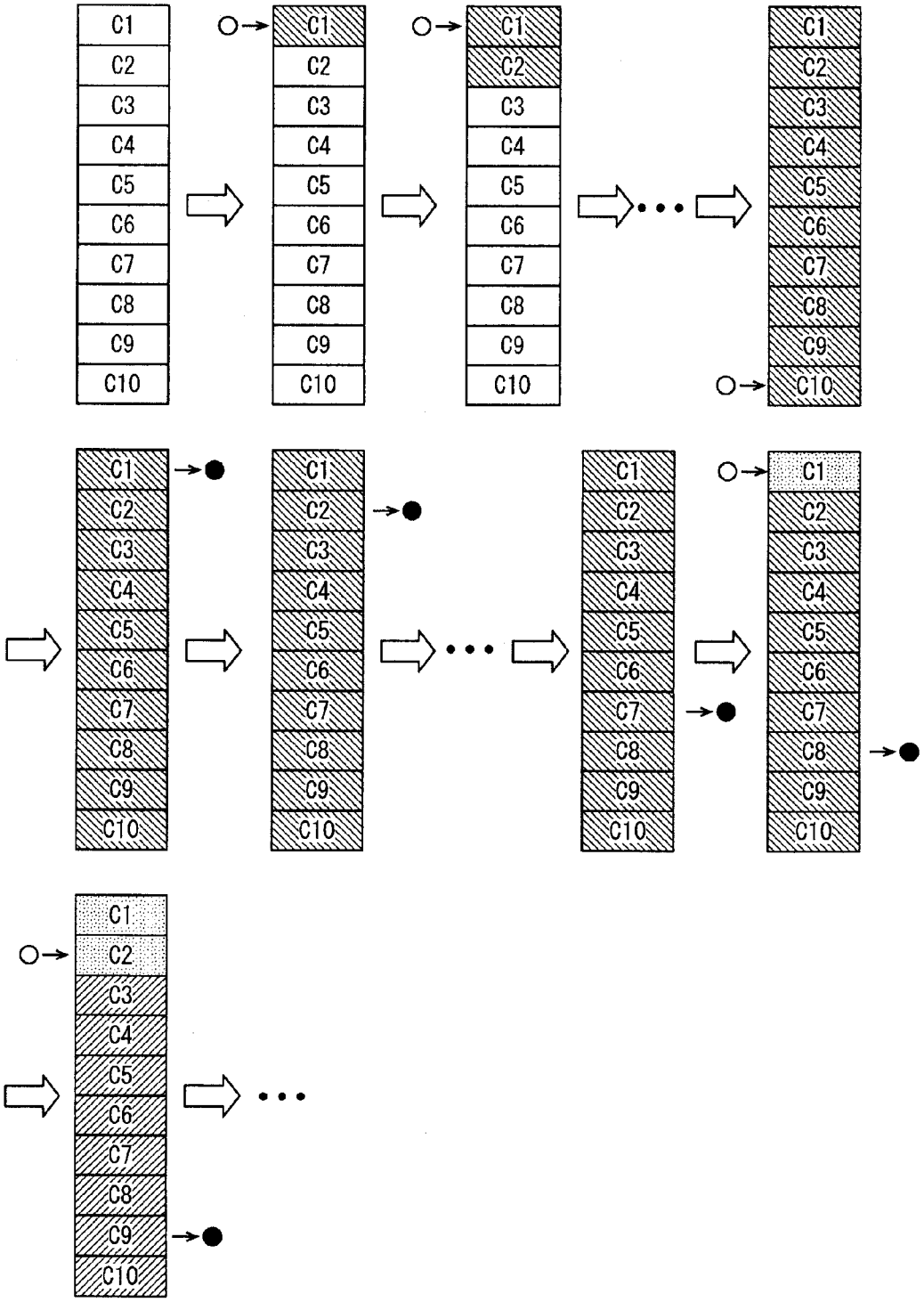
FIG. 20 is a diagram for illustrating the operation of the memory of the controller of the second preferred embodiment.

When display data is written into the memory 111, the first piece of display data is written into the cell C1, and the second piece of display data is written into the cell C2, and thus the inputted display data are sequentially stored from C1. Thus the first to tenth pieces of data are stored respectively into the cells C1 to C10. In FIG. 20, white circles represent display data being written, and cells in which the first line of data has been stored are diagonally shaded.

On the other hand, when the display data is read from the memory 111, the display data is read in the order of cell C1, cell C2, cell C3, . . . , C10. In FIG. 20, black circles represent display data being read.

Also, the memory 111 can perform data read and write in parallel. For example, when the input of the display data of the second line starts while the display data of the first line stored in the cell C8 is being read, the display data of the second line are sequentially stored from the cell C1. As stated above, reading operation is performed in the order of cell C1, cell C2, . . . , so that the data of the first pixel line stored in the cell C1 has already been read out when the display data of the first line stored in the cell C8 is being read. In this way, with the memory 111, as long as the writing operation of display data of the (i+1)th line does not overtake the reading operation of the display data of the ith line (i is an arbitrary positive number), the data writing operation of the (i+1)th line can be started while the display data of the ith line is being read.

On the basis of control signals from the system 100, the timing controller 112 outputs the horizontal start signal STH, the latch signal LP for controlling the second data latch circuit 54, a polarity reversal signal POL for reversing the polarity of driving of liquid crystal, display data in the memory 111, etc. to the source driver 40. It also outputs the vertical direction start pulse sty and clock signals clk, /clk to the level shifter 120. The timing controller 112 controls the timings of output of these signals on the basis of the detect signal GOFF from the gate line inactivation transition detecting circuit 90.

Now, referring to FIG. 19, the operation of the controller 110 will be described. When the display signal DIN1 and control signal for the first line outputted from the system 100 are inputted to the controller 110, the display data DM1 contained in the display signal DIN1 is sequentially written into the memory 111.

From given time t1 before the time (time t2) at which the display signal DIN2 and control signal for the second line are inputted to the controller 110, the timing controller 112 reads out the display data DM1 for the first line from the memory 111 in the order in which the data was written in. The data is sent as output data DO1 (corresponding to the display signal SIG) to the source driver 40 together with the horizontal start signal STH. At this time, the timing controller 112 activates the vertical direction start pulse sty.

From time t2, the input of the display signal DIN2 and control signal for the second line into the controller 110 starts, and the display data DM2 contained therein is sequentially written into the memory 111.

The timing controller 112 activates the latch signal LP at certain time t5 between the time (time t3) when it finished outputting all output data. DO1 of the first line to the source driver 40 and the time (time t8) when the input of the display signal DIN3 and control signal of the third line is started. Then the display data of the first line is held in the second data latch circuit 54.

From certain time t6 after the activation of the latch signal LP, the timing controller 112 reads out the display data DM2 of the second line from the memory 111 in the order in which the data was written in, and outputs the data as the output data DO2 to the source driver 40 together with the horizontal start signal STH. At this time, the timing controller 112 activates the clock signal clk. The polarity reversal signal POL is toggled at certain time t4 prior to the rise of the data latch signal LP (time t5).

When the clock signal clk is activated, the clock signal CLK level-converted by the level shifter 120 is activated. In response, the gate line driving signal $G_1$ for the first line outputted from the gate line driving circuit 30 is activated, and the gate line $GL_1$ is selected.

From time t8, the input of the display signal DIN3 and control signal for the third line into the controller 110 starts, and the display data DM3 contained therein is sequentially written into the memory 111.

When the writing of the first line into the pixels 25 ends, the gate line inactivation transition detecting circuit 90 activates the detect signal GOFF. When the timing controller 112 detects the activation of the detect signal GOFF, it activates the latch signal LP at time t10 after a given time has passed, in order to cause the second data latch circuit 54 to hold the display data of the second line.

From given time t11 after the activation of the latch signal LP, the timing controller 112 reads the display data DM3 for the third line from the memory 111 in the order in which the data was written, and sends the data as output data DO3 to the source driver 40 together with the horizontal start signal STH. At this time, the timing controller 112 activates the clock signal/clk. The polarity reversal signal POL, is toggled at certain time t9 between the rise of the latch signal LP corresponding to the first line (time t5) and the rise of the latch signal LP corresponding to the second line (time t10).

When the clock signal/clk is activated, the clock signal /CLK level-converted by the level shifter 120 is activated. In response, the gate line driving signal $G_2$ for the second line outputted from the gate line driving circuit 30 is activated, and the gate line $GL_2$ is selected.

After that, the above-described operations are repeated. In this way, on the basis of the timing with which a gate line GL changes to an inactive state (non-selected state) (i.e. the timing of activation of the detect signal GOFF), the timing controller 112 outputs the display data SIG (output data DO1, DO2, . . . ), horizontal start signal STH, latch signal LP, and polarity reversal signal POL with proper timings.

When the memory 111 holds display data for one pixel line as described in this preferred embodiment, the period in which the timing controller 112 can adjust the timings of activation of signals sent to the source driver 40 and the gate line driving circuit 30 is limited to the period until the end of the input of the display data and control signal for the next line to the controller 110. When the period in which timing adjustment is required extends over following n line(s) ($n \geq 1$), the memory 111 is configured to be capable of holding display data for n line(s). This lengthens the period in which the timings of activation of signals can be adjusted.

Figure 19:
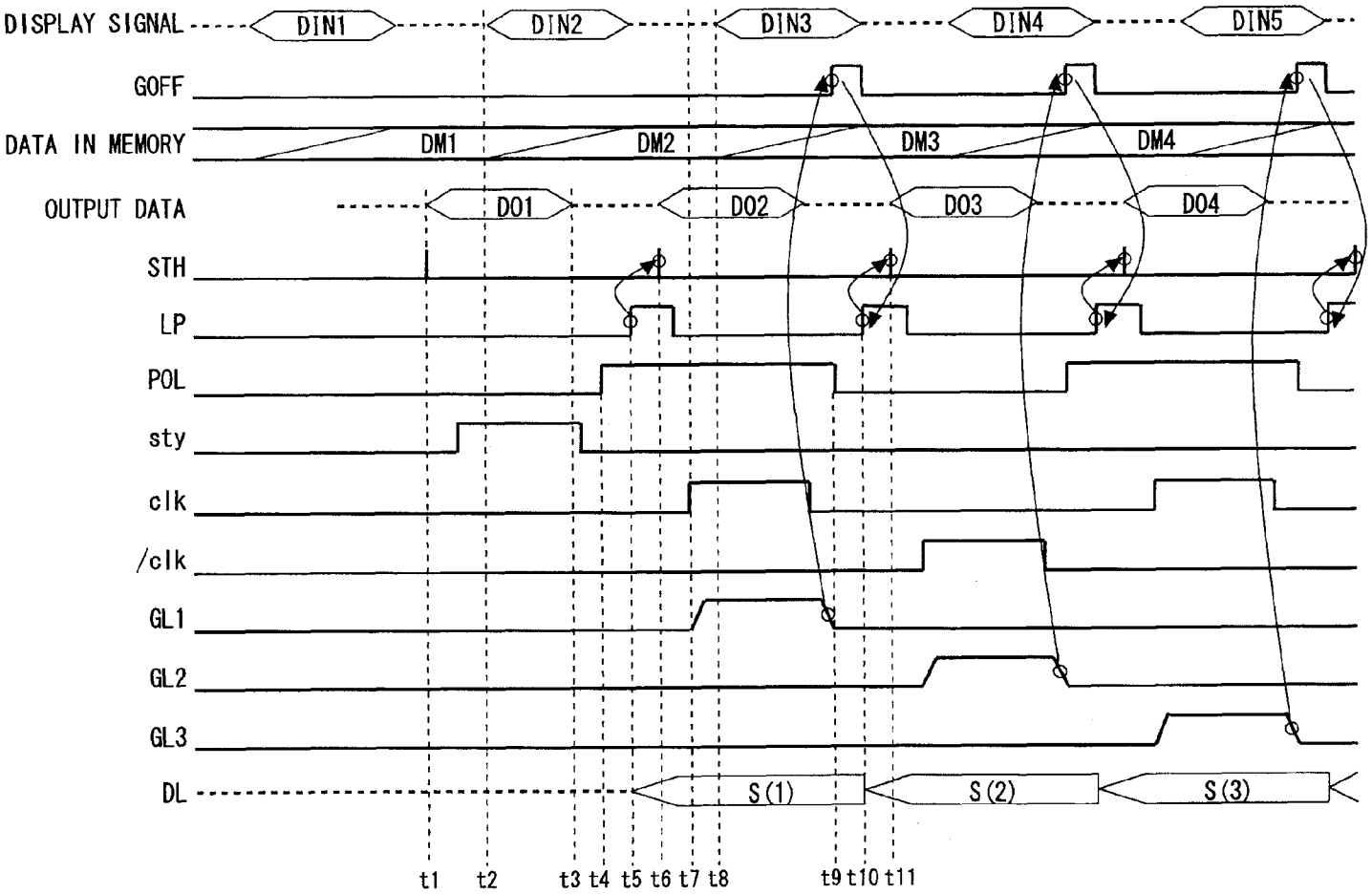
FIG. 19 is a signal waveform diagram illustrating the operation of the controller according to the second preferred embodiment.

The timings of times t1 to t11 shown in FIG. 19 are not limited to those shown in the diagram, but can be modified as long as no contradiction arises. Also, this preferred embodiment has shown an example in which the polarity reversal signal POL reverses polarity for each pixel line, but it can be easily applied to examples in which it reverses polarity for a plurality of pixel lines.

The description above assumes that the liquid-crystal array portion 20, gate line driving circuit 30, and level shifter 120 of a liquid-crystal display apparatus are integrated together, but the level shifter 120 may be applied to a display apparatus using a semiconductor integrated circuit formed of single crystal silicon. In this case, a display apparatus capable of higher-speed operation can be realized.

Third Preferred Embodiment

Figure 21:
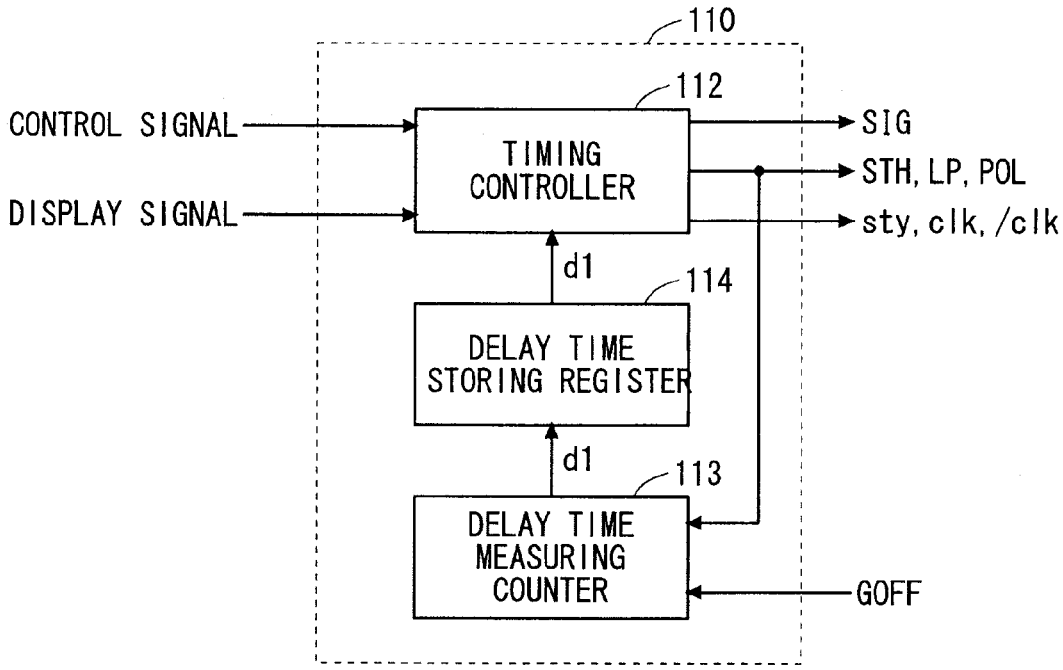
FIG. 21 is a schematic block diagram of a controller according to a third preferred embodiment.

A third preferred embodiment shows an example of the configuration of a controller 110 that can prevent display errors due to the delay of gate line driving signals G. FIG. 21 is a block diagram illustrating the configuration of the controller 110 of the third preferred embodiment. As shown in FIG. 21, the controller 110 includes a timing controller 112, a delay time measuring counter 113, and a delay time storing register 114. The control signals and display signal outputted from the system 100 are inputted to the timing controller 112. The detect signal GOFF outputted from the gate line inactivation transition detecting circuit 90 (or the dummy gate line inactivation transition detecting circuit 140) is inputted to the delay time measuring counter 113.

By using a reference clock (a dot clock or divided clock thereof), the delay time measuring counter 113 counts the delay time of the detect signal GOFF with respect to the latch signal LP for updating the display signal held in the data latch circuit (the display signal inputted to the decode circuit 70). Since the delay times are nearly equal at individual pixel lines, the measurement is performed only at a particular pixel line of each frame (e.g. the first line). The delay time measured by the delay time measuring counter 113 is stored in the delay time storing register 114.

In the blank period of each frame, the timing controller 112 reads and refers to the delay time held in the delay time storing register 114, and operates to shift ahead the rising and falling timings of the gate clocks clk, /clk and vertical direction start signal sty by the delay time.

Figure 22:
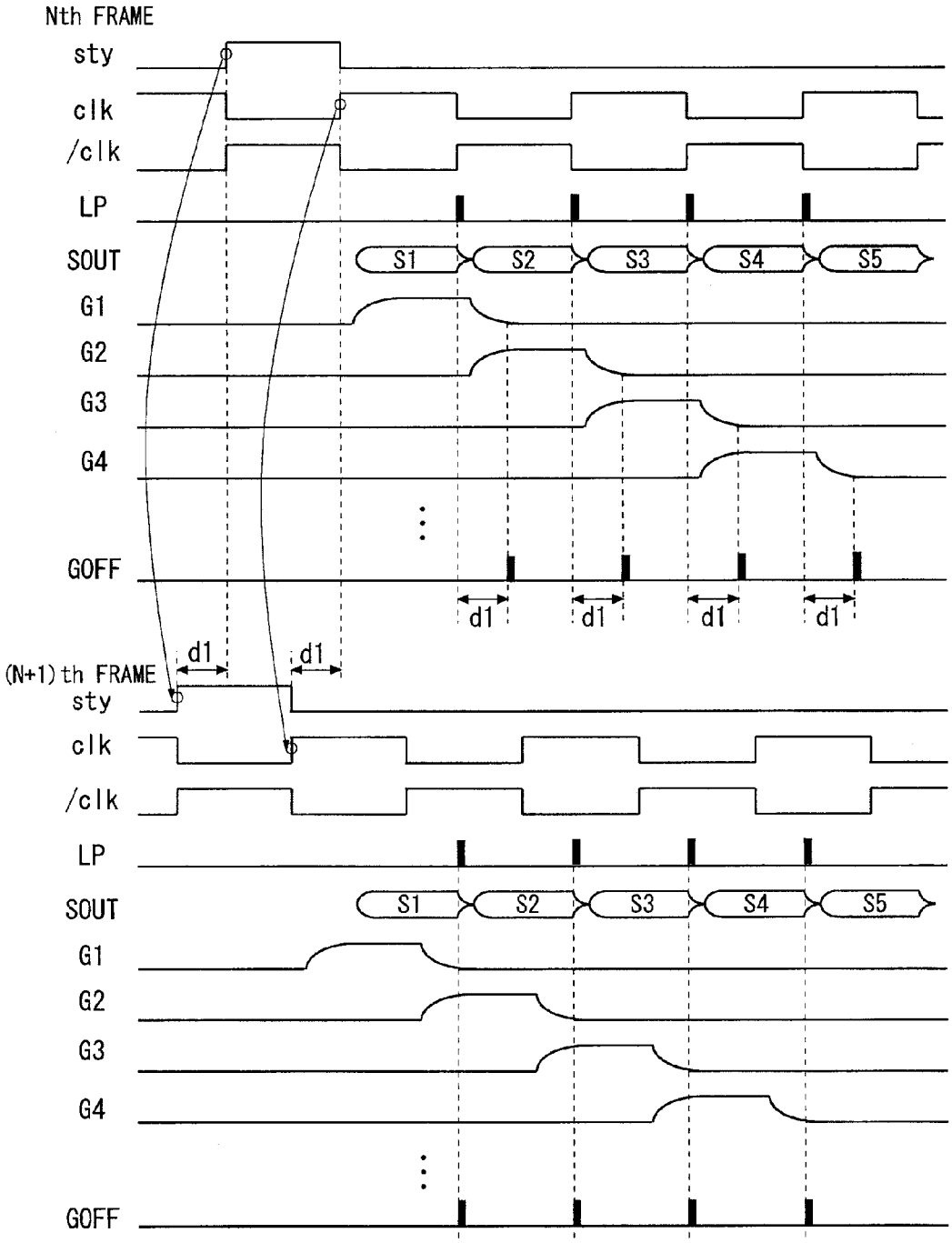
FIG. 22 is a signal waveform diagram illustrating the operation of the controller according to the third preferred embodiment.

Now, the operation of the controller 110 of this preferred embodiment will be described. FIG. 22 is a signal waveform diagram illustrating the operation. In FIG. 22, "SOUT (S1, S2, S3 . . . )" indicates display signals outputted from the source driver 40 to the data lines DL.

For example, as shown in FIG. 22, in the Nth frame, as a result of the measurement by the delay time measuring counter 113, the value of the delay time of the detect signal GOFF with respect to the latch signal LP of the first pixel line is d1. This delay time d1 is stored in the delay time storing register 114.

When the display period of the Nth frame ends and the blank period starts, the timing controller 112 refers to the delay time d1 stored in the delay time storing register 114, and shifts ahead, by the delay time d1, the rising and falling timings of the gate clocks clk, /clk and vertical direction start signal sty in the next (N+1)th frame.

As a result, the delay of the gate line driving signal G is corrected, and the latch signal EP and the detect signal GOFF are activated with the same timing in the (N+1)th frame. That is to say, at each pixel line, the display signal SOUT is switched when the gate line driving signal G falls. Display errors due to the delay of the gate line driving signals G are thus prevented.

According to the controller 110 of this preferred embodiment, the capacity of memory can be smaller than that in the controller of the second preferred embodiment, and the circuit scale can be reduced.

Conventionally, for the purpose of preventing overwriting of the previous pixel line with the display signal of the next pixel line, a method is used in which a certain margin is provided between the falling timing of the gate line driving signal G and the switching timing of the display signal SOUT. However, in this method, the writing time to the pixels is reduced. In this preferred embodiment, the display signal SOUT is switched correctly immediately after a fall of the gate line driving signal G, and therefore such margin is not needed. That is to say, it is possible to prevent display errors without reducing the writing time to pixels.

While the invention has been described in detail, the foregoing description is in all aspects illustrative and not restrictive. It is understood that numerous other modifications and variations can be devised without departing from the scope of the invention.

What is claimed is:

1. An image display apparatus comprising:

a plurality of gate lines;

a plurality of data lines intersecting with said plurality of gate lines;

a plurality of pixels formed in the vicinities of intersections of said plurality of gate lines and said plurality of data lines;

a source driver that has a latch circuit for holding display data for one pixel line and that supplies a signal corresponding to said display data to said plurality of pixels through said data lines;

a gate line driving circuit that drives said plurality of pixels by sequentially activating said plurality of gate lines; and an inactivation transition detecting circuit that activates a detect signal for a certain period when detecting inactivation of each of said plurality of gate lines, wherein said latch circuit updates held display data in response to the activation of said detect signal, said inactivation transition detecting circuit includes detecting circuits that are provided respectively for said plurality of gate lines to activate the detect signal when corresponding gate lines are inactivated, each said detecting circuit transmits a first signal to a gate of a first transistor to charge an output terminal of said detect signal and transmits a second signal to a gate of a second transistor to charge the output terminal a certain time after charging of the output terminal, each said detecting circuit inactivates said first transistor and said second transistor while said corresponding gate line is active, when said corresponding gate line is inactivated, each said detecting circuit first activates said first transistor, and after said certain time has passed, activates said second transistor and inactivates said first transistor approximately simultaneously, and inactivates said second transistor after a further certain time has passed, and transistors forming said inactivation transition detecting circuit are all of a same conductivity type.

2. The image display apparatus according to claim 1, wherein said gate line driving circuit is integrated with said plurality of pixels.

3. The image display apparatus according to claim 2, further comprising a level shifter that converts a control signal for said gate line driving circuit to a level capable of driving said gate line driving circuit, wherein the gate line driving circuit is integrated also with said level shifter.

4. The image display apparatus according to claim 1, wherein said gate lines are dummy gate lines provided separately from normal gate lines for displaying images, and said gate line driving circuit is a dummy gate line driving circuit that sequentially activates said dummy gate lines with a timing synchronized with said normal gate lines.

5. The image display apparatus according to claim 4, wherein said dummy gate line driving circuit is driven by using a clock signal for driving a driving circuit for said normal gate lines.

6. The image display apparatus according to claim 4, wherein a driving circuit for said normal gate lines and said dummy gate line driving circuit are integrated with said plurality of pixels.

7. The image display apparatus according to claim 6, further comprising a level shifter that converts a control signal for said gate line driving circuit to a level capable of driving said gate line driving circuit, wherein said driving circuit for said normal gate lines and said dummy gate line driving circuit are integrated also with said level shifter.

8. The image display apparatus according to claim 1, further comprising a controller that defines output timings of signals sent to said source driver and gate line driving circuit on the basis of said detect signal.

9. The image display apparatus according to claim 8, wherein said controller includes:

a memory that holds display data for at least one pixel line; and a timing controller that, on the basis of said detect signal, reads said display data for each one pixel line from said memory and outputs the display data to said source driver.

10. An image display apparatus comprising:

a plurality of gate lines;

a plurality of data lines intersecting with said plurality of gate lines;

a plurality of pixels formed in the vicinities of intersections of said plurality of gate lines and said plurality of data lines;

a source driver that has a latch circuit for holding display data for one pixel line and that supplies a signal corresponding to said display data to said plurality of pixels through said data lines;

a gate line driving circuit that drives said plurality of pixels by sequentially activating said plurality of gate lines; and an inactivation transition detecting circuit that activates a detect signal for a certain period when detecting inactivation of each of said plurality of gate lines, wherein said latch circuit updates held display data in response to the activation of said detect signal, wherein said inactivation transition detecting circuit includes detecting circuits that are provided respectively for said plurality of gate lines to activate the detect signal when corresponding gate lines are inactivated, and wherein each said detecting circuit comprises:

a detector that activates a first signal when detecting inactivation of said corresponding gate line;

a delay circuit that generates a second signal by delaying said first signal by a given time;

a pull down circuit that inactivates said first signal in response to activation of said second signal; and an output portion that activates said detect signal in response to activation of said first signal and inactivates said detect signal in response to activation of said second signal.

11. The image display apparatus according to claim 10, wherein said detector includes an inverter that has an input end connected to said gate line and that outputs said first signal, and for said inverter, a voltage of said gate line at which said first signal is inverted can be adjusted by adjusting an on-state resistance ratio of a load element and a drive element of said inverter.

* * * * *